US007489223B2

(12) United States Patent
Yokoyama et al.

(10) Patent No.: US 7,489,223 B2
(45) Date of Patent: Feb. 10, 2009

(54) INDUCTOR AND METHOD OF MANUFACTURING THE SAME

(75) Inventors: Takeshi Yokoyama, Matsumoto (JP); Yoshikiyo Usui, Matsumoto (JP); Tomonori Seki, Azumino (JP)

(73) Assignee: Fuji Electric Device Technology Co., Ltd. (JP)

( * ) Notice: Subject to any disclaimer, the term of this patent is extended or adjusted under 35 U.S.C. 154(b) by 0 days.

(21) Appl. No.: 11/957,465

(22) Filed: Dec. 16, 2007

(65) Prior Publication Data

US 2008/0143468 A1 Jun. 19, 2008

(30) Foreign Application Priority Data

Dec. 18, 2006 (JP) ..... 2006-340253

(51) Int. Cl.
*H01F 5/00* (2006.01)

(52) U.S. Cl. ..... 336/200

(58) Field of Classification Search ..... 336/65, 336/83, 200, 206–208, 232
See application file for complete search history.

(56) References Cited

U.S. PATENT DOCUMENTS 6,930,584 B2 8/2005 Edo et al.
7,268,659 B2 * 9/2007 Nishio et al. ..... 336/200
2004/0179383 A1 * 9/2004 Edo et al. ..... 363/111
2008/0136575 A1 * 6/2008 Edo et al. ..... 336/200

FOREIGN PATENT DOCUMENTS

JP 2004-274004 A 9/2004

* cited by examiner

*Primary Examiner*—Tuyen T. Nguyen
(74) *Attorney, Agent, or Firm*—Rossi, Kimms & McDowell, LLP

(57) ABSTRACT

An inductor and a method of manufacture results in external electrodes that prevent generation of flashes. The inductor has a ferrite substrate, external electrodes, and a coil. The cross-sectional area of the external electrodes extending across the cutting line is reduced to suppress generation of flashes during the cutting process. Pairs of through-holes are formed at positions in line symmetry about the cutting line. A connection conductor is formed in each of the through-holes, and the external electrodes are formed on the front and back surfaces of the substrate, with the connection conductor connecting each of the pairs of external electrodes on the front and back surfaces. Through-holes can be oblong holes extending across the cutting line, and the external electrodes can extend away from the cutting line.

15 Claims, 21 Drawing Sheets

Fig. 2A
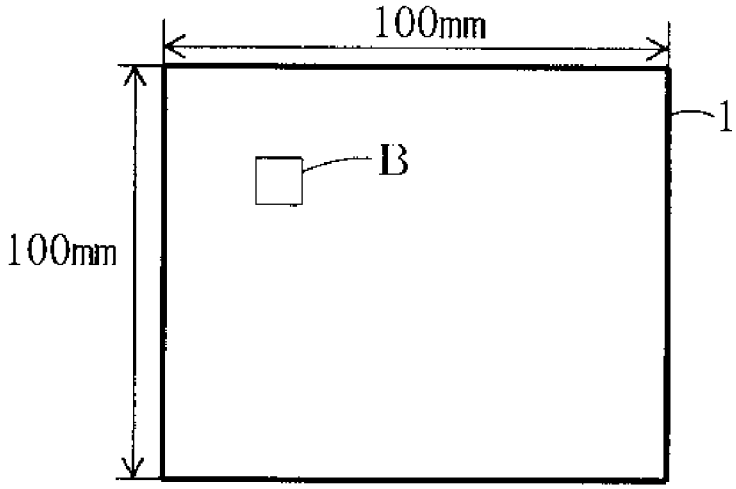
Fig. 2B
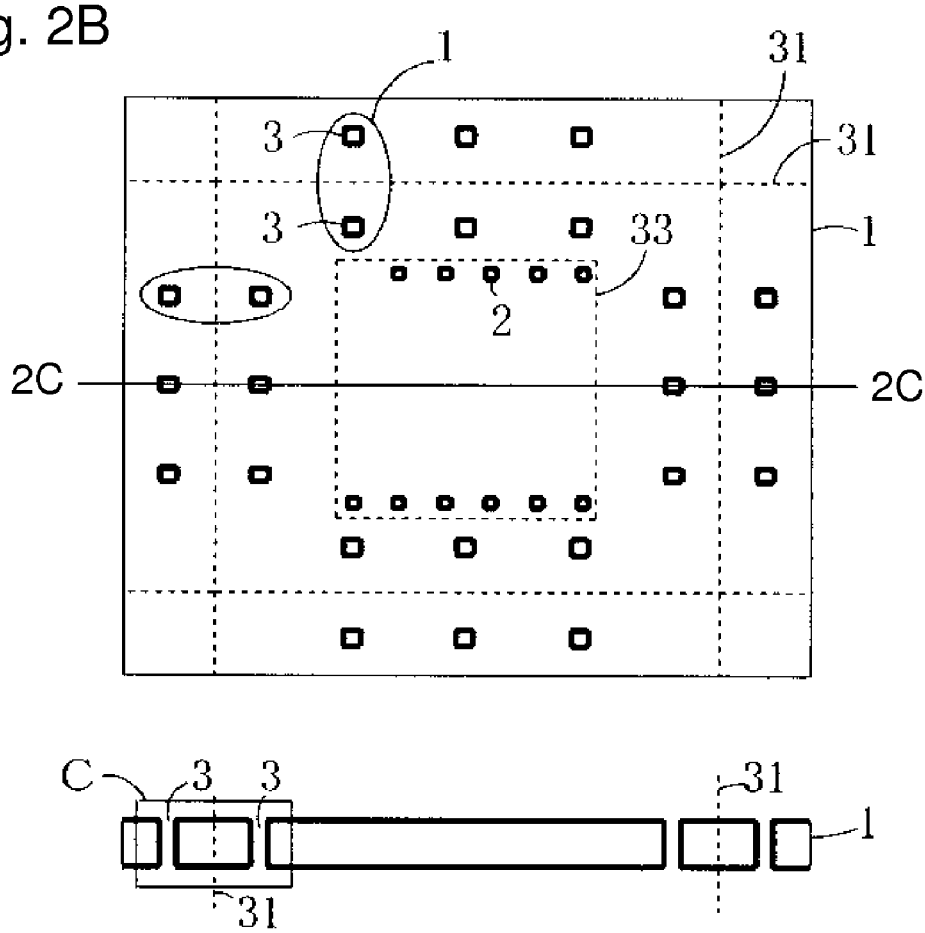
Fig. 2C

Fig. 8A
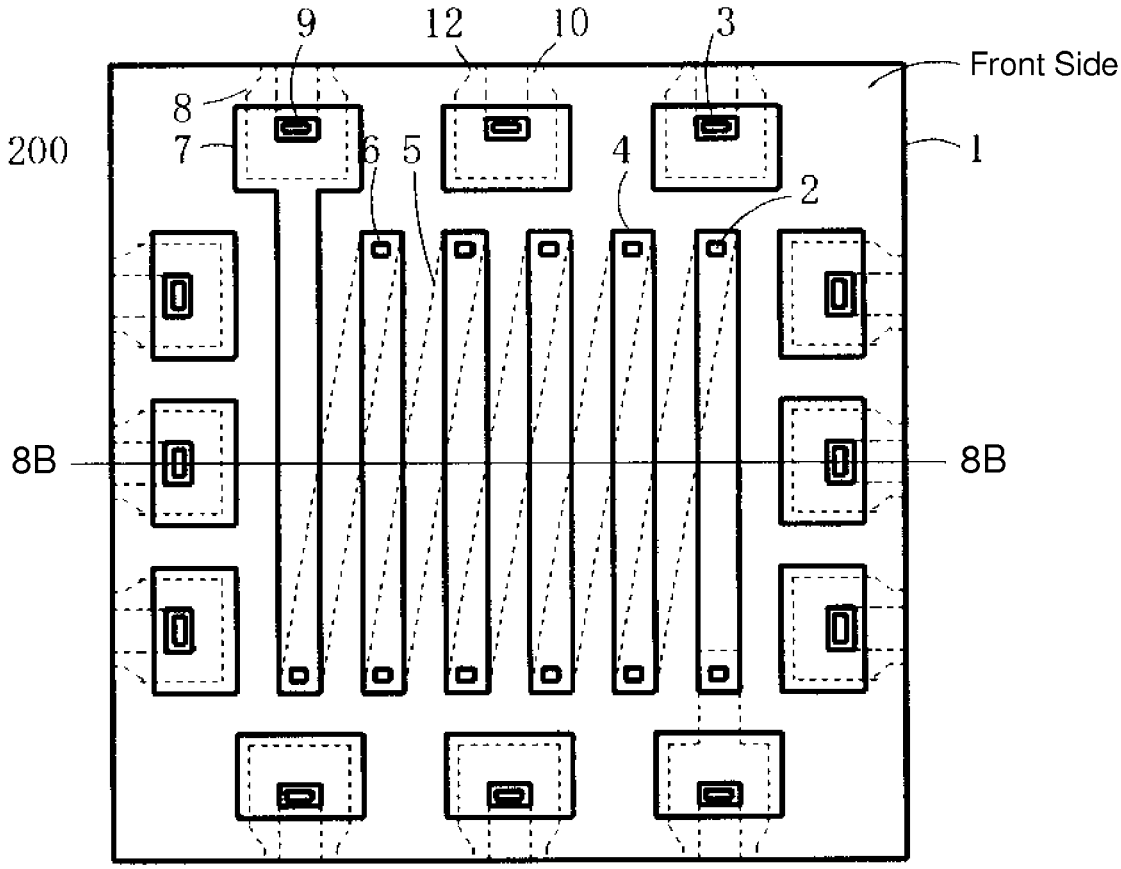
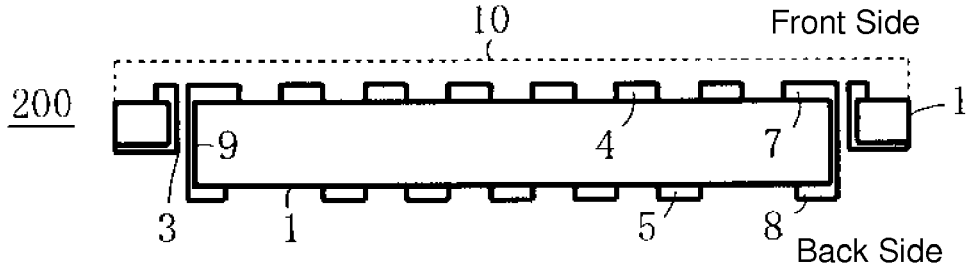
Fig. 8B

Fig. 9A
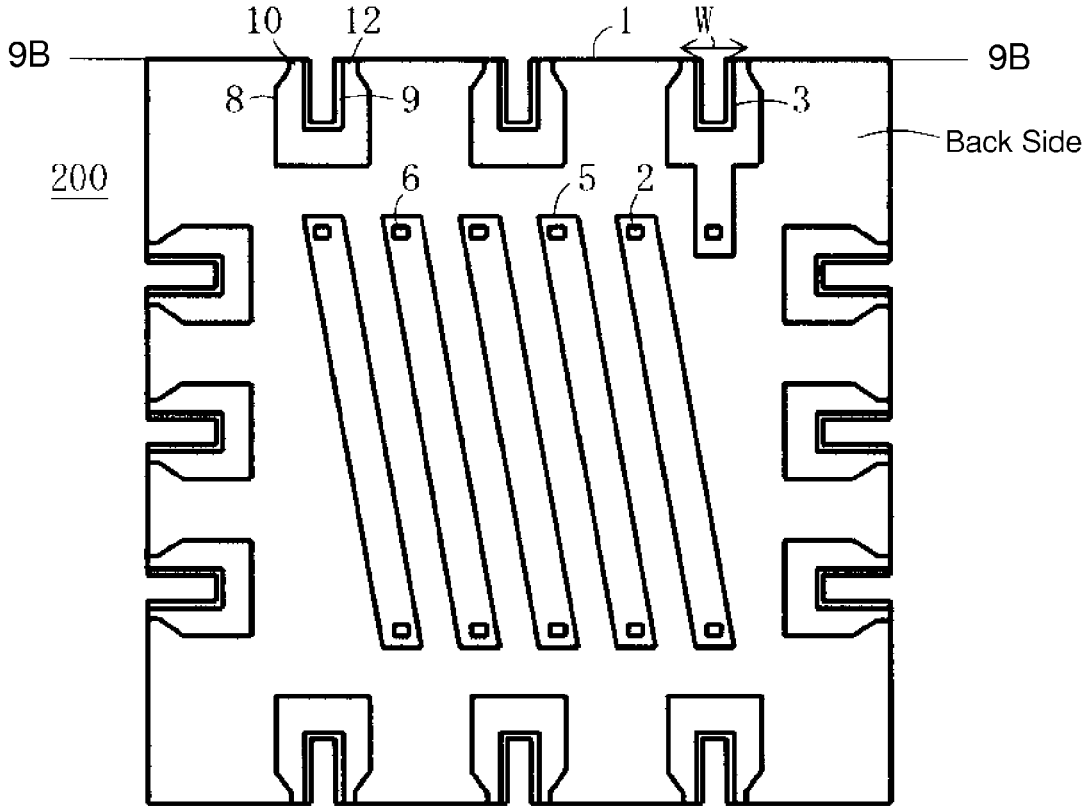
(a)
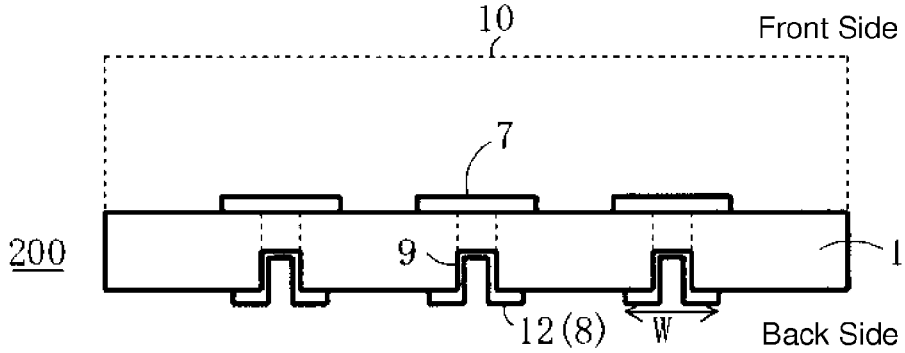
Fig. 9B

Fig. 10A
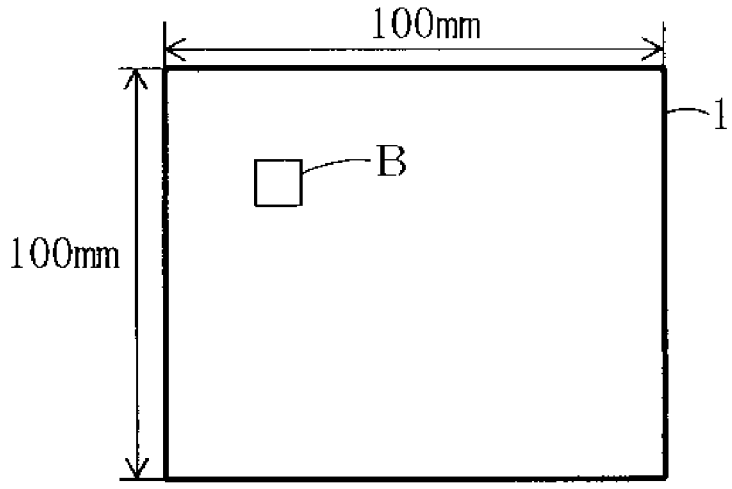
Fig. 10B
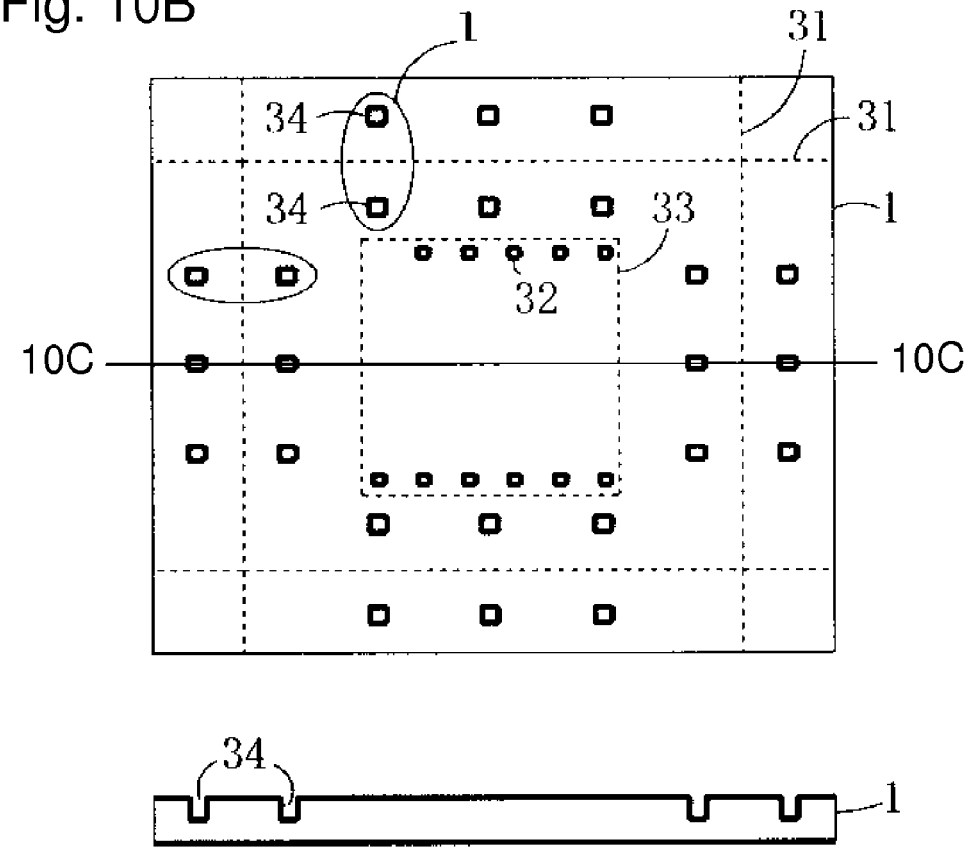
Fig. 10C

Fig. 11A
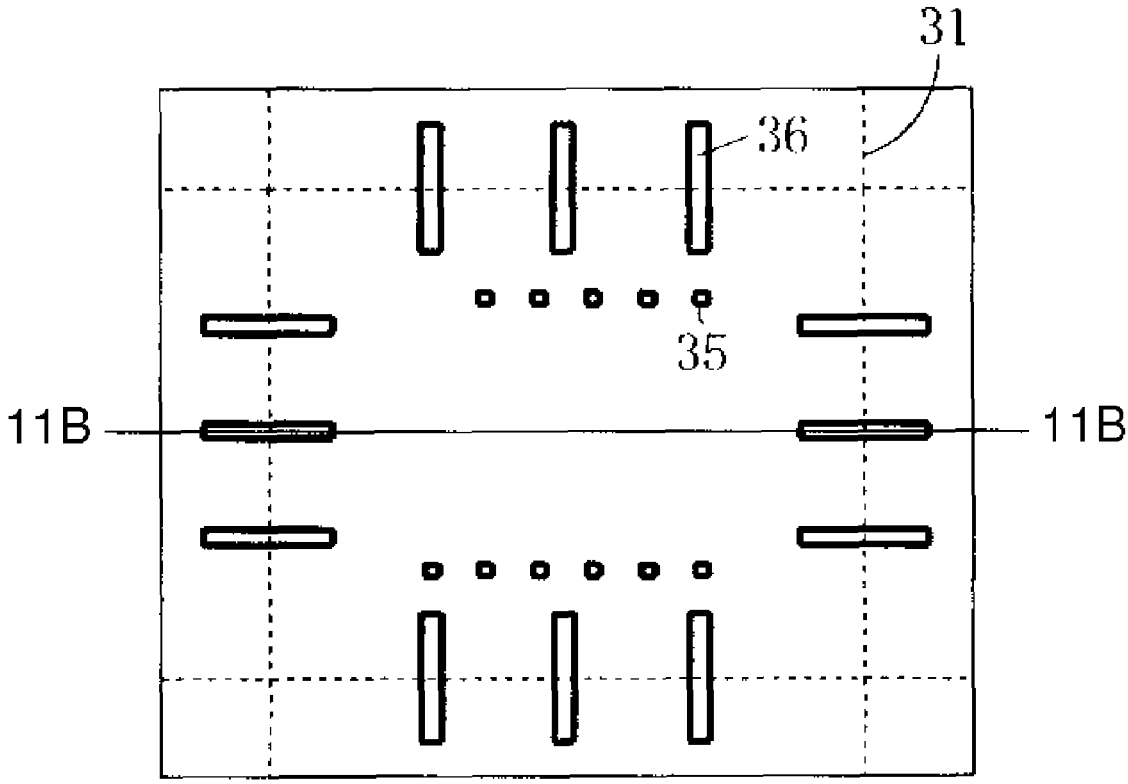
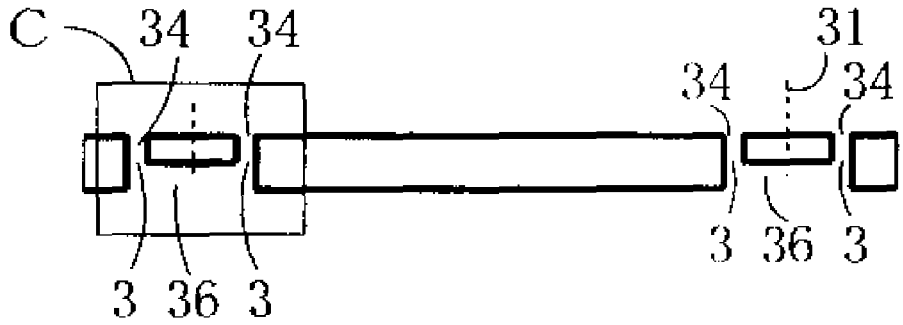
Fig. 11B

Fig. 20A
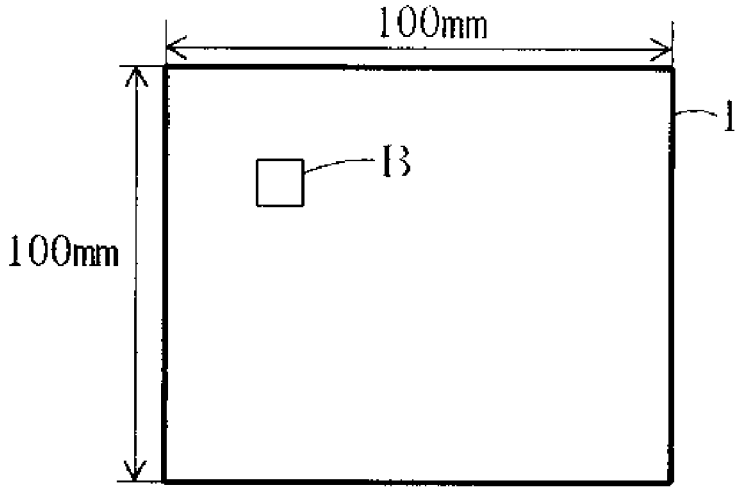
Fig. 20B
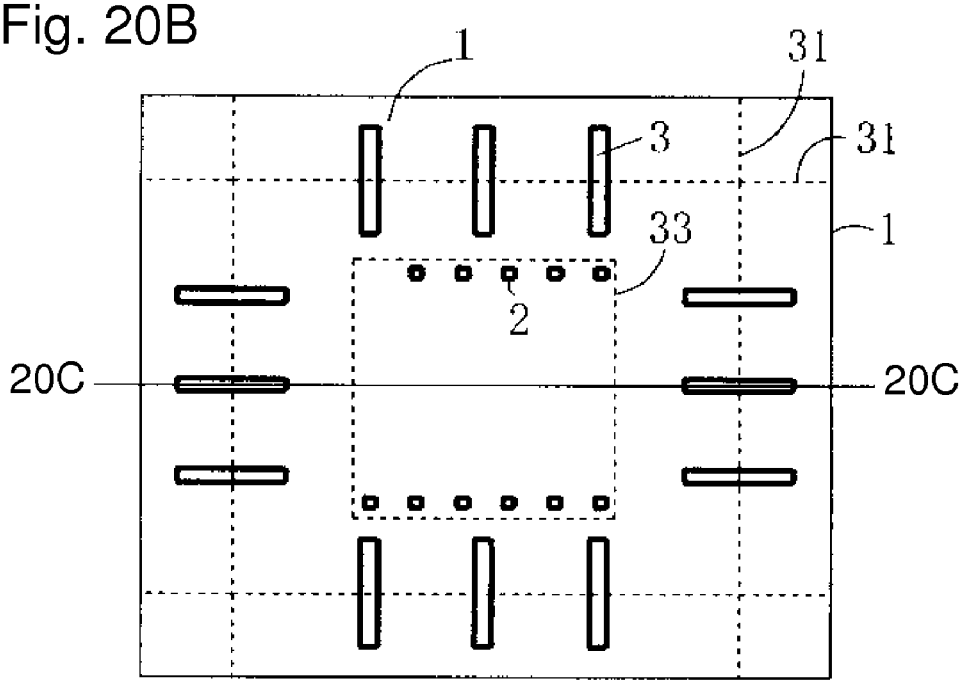
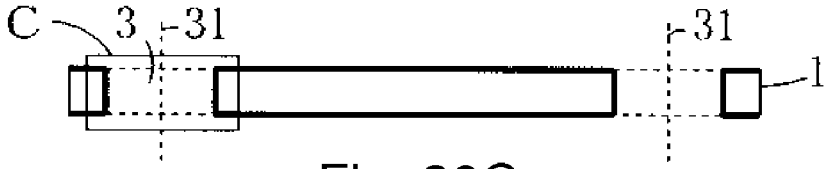
Fig. 20C

Fig. 21
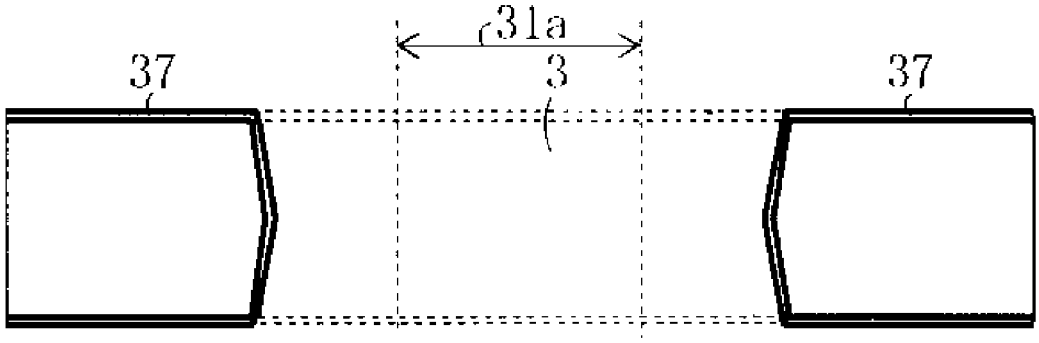
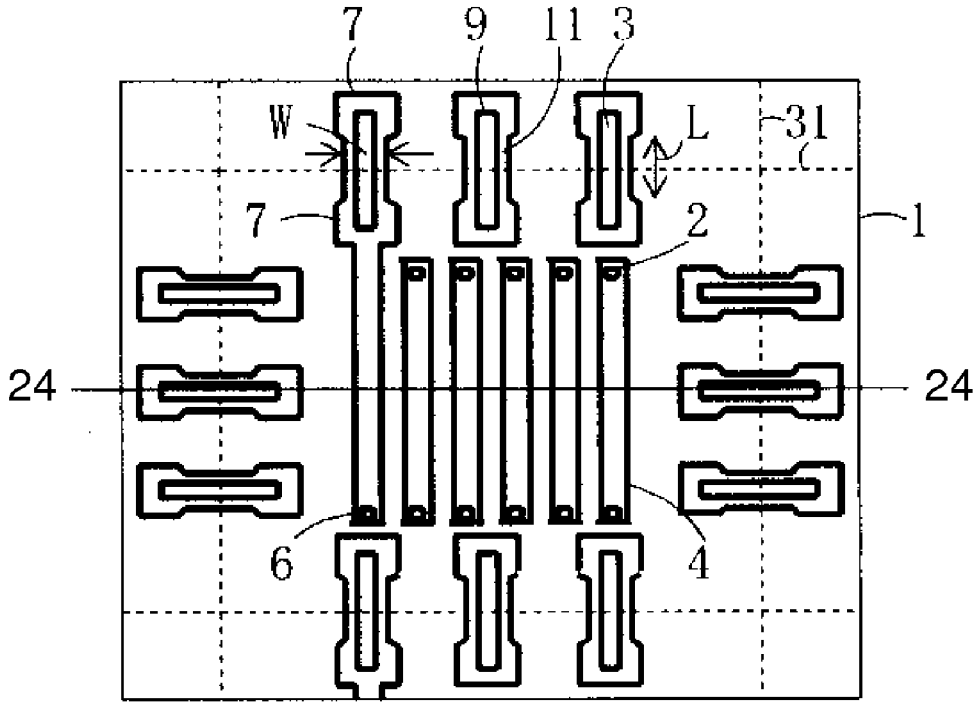
L: Length of Cutting Place
Fig. 22

Fig. 25
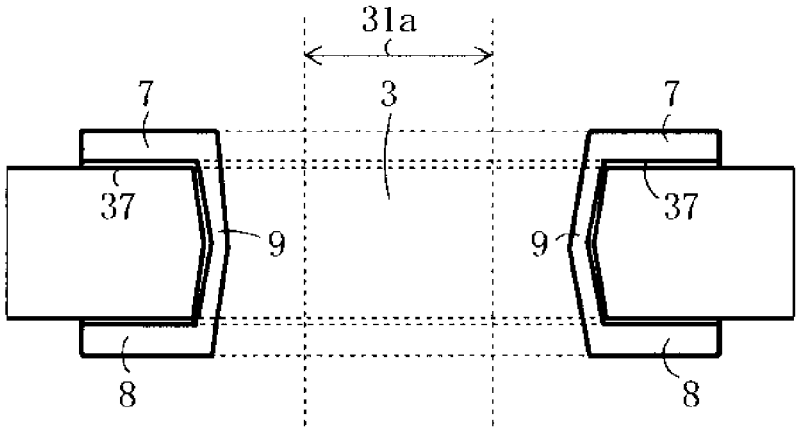
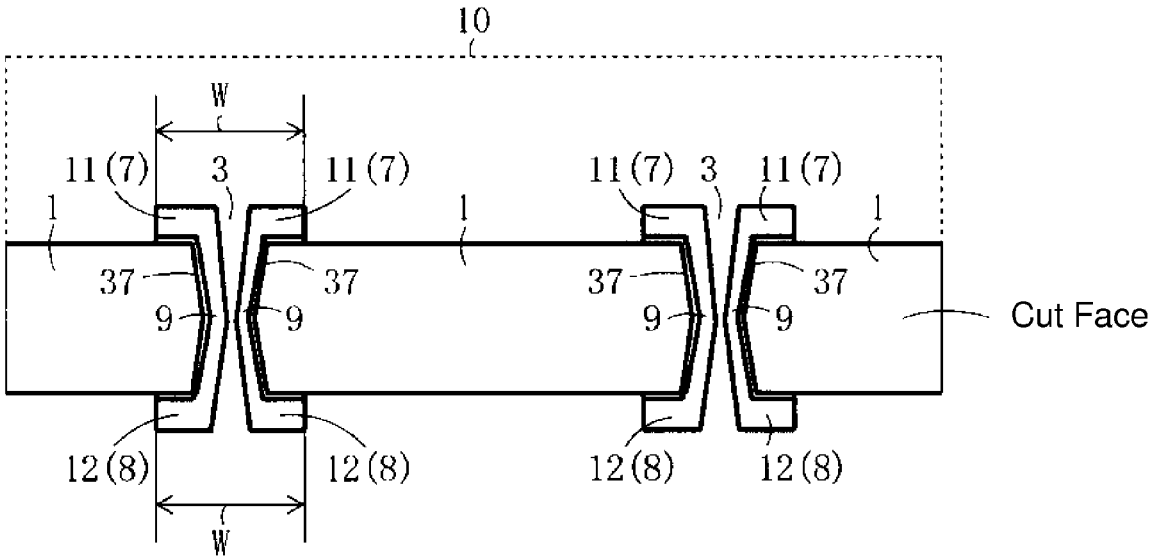
Fig. 26

INDUCTOR AND METHOD OF MANUFACTURING THE SAME

BACKGROUND

A conventional microminiature power converter, such as a DC-DC converter employed in a micro power supply, has a power supply IC chip mounted on an inductor by flip chip bonding or adhesion with an adhesive, connected by gold lines (bonding wires), and sealed with a mold resin such as an epoxy resin. Such an inductor is illustrated in FIGS. 30A, 30B, 30C, which show a structure of a conventional inductor 500. FIG. 30A is a plan view of an essential part of the inductor 500, FIG. 30B is a sectional view taken along the line 30B-30B of FIG. 30A, and FIG. 30C is a side view of the part A of FIG. 30A.

The inductor 500 is composed of a ferrite substrate 51, first and second coil conductors 54, 55, first connection conductors 56, first and second external electrodes 57, 58, and second connection conductors 59. A solenoid coil is formed in a central region of the ferrite substrate 51. A plurality of external electrodes are formed in the peripheral region of the ferrite substrate 51 surrounding the coil. The coil is composed of first coil conductors 54 on a front side (also referred to as a front surface side) of the ferrite substrate 51, second coil conductors 55 on a back side (also referred to as a back surface side) of the ferrite substrate 51, and first connection conductors 56 that are formed on a side wall of first through-holes 52 and connecting the coil conductors 54, 55. The external electrodes are arranged in the peripheral region of the ferrite substrate surrounding the coil and extending to the edge of the ferrite substrate 51. The external electrodes are composed of first external electrodes 57 formed on the front side of the ferrite substrate 51 and second external electrodes 58 formed on the back side of the ferrite substrate 51 at the places corresponding to the first external electrodes. The first and second external electrodes 57, 58 are connected by second connection conductors 59 formed on the side wall of the second through-holes 53. Each of the first connection conductor 56 and the second connection conductor 59 is surrounded by the ferrite substrate 51.

Japanese Unexamined Patent Application Publication No. 2004-274004, which corresponds to U.S. Pat. No. 6,930,584 B2, discloses a microminiature power converter having a power supply IC chip mounted on a coil substrate by flip chip bonding. This reference discloses that an inductance value can be increased by setting the length of the coil conductor constructing a planar type solenoid coil at a value larger than a predetermined value with respect to the width of the magnetic insulating substrate (a ferrite substrate). The front side of the ferrite substrate 51 is covered by an epoxy resin 60.

Each inductor 500, as shown in FIGS. 30A, 30B, 30C, is formed by cutting the first and second external electrodes 57, 58, the ferrite substrate 51, and the epoxy resin 60 along a scribe or cutting line. In that process, if the width W0 of the first and second external electrodes 57, 58 is wide, a flash 63 is generated, as shown in FIG. 31, at the second external electrode 58, which is not covered by epoxy resin, while such a flash is not created at the first external electrode 57, which is fixed with an epoxy resin 60. If the second external electrodes 58 with the flash 63 are soldered with a solder 64 to a packaging substrate 71, a solder bridge 65 is formed between the adjacent external electrodes 58 through the flash 63, short-circuiting the second external electrodes 58, as shown in FIG. 32. FIGS. 31 and 32 are side views of the part A of FIG. 30A. In FIG. 32, the dotted lines 66 show the configuration of the solder when no flash is generated, and the reference numeral 72 indicates a wiring on the packaging substrate.

In the device of the above-identified reference, external electrodes extend to the edge of the ferrite substrate like the structure shown in FIGS. 30A, 30B, 30C. But, the connection conductor connecting the external electrodes on the front and back surfaces is exposed to the edge of the ferrite substrate, which is different from the structure in FIGS. 30A, 30B, 30C. In that case too, the external electrodes causes generation of flashes in the cutting process along a scribe line like the structure of FIGS. 30A, 30B, 30C.

Accordingly, there remains a need to solve the above problem and provide an inductor having external electrodes that does not cause generation of flashes. The present invention address this need.

SUMMARY OF THE INVENTION

The present invention relates to an inductor and a method of manufacturing an inductor that can be mounted on a microminiature power converter or the like.

One aspect of the present invention is an inductor. The inductor includes a magnetic insulating substrate, a coil in a central region of the magnetic insulating substrate, and external electrodes on front and back surfaces in a peripheral region of the magnetic insulating substrate, with each pair of external electrodes on the first and back surfaces electrically connected with each other. At least one of the external electrodes on the front surface or the back surface has a portion that extends to a peripheral edge of the magnetic insulating substrate. Moreover, the cross-sectional area of the portion of the one external electrode at the peripheral edge is smaller than a cross-sectional area thereof positioned inside of the peripheral edge of the magnetic insulating substrate.

Either the width or thickness (or both) of the portion of one external electrode at the peripheral edge can be smaller than the width or thickness (or both) thereof positioned inside of peripheral edge of the magnetic insulating substrate. The coil can be a solenoid coil, a spiral coil, or a toroidal coil. The magnetic insulating substrate is a ferrite substrate.

Another aspect of the present invention is forming the above-described inductor. The method can include forming pairs of through-holes at positions in line symmetry about a cutting line, forming a connection conductor on a side wall of each of the through-holes and the external electrodes on the front and back surfaces of the magnetic insulating substrate, with the connection conductor connecting each of the pairs of external electrodes, forming the coil in the coil-forming region inside the cutting line, and cutting the external electrodes and the magnetic insulating substrate along the cutting line. At least one of the external electrodes on the front or back surface has a portion crossing the cutting line. The cross-sectional area of the portion at the cutting line is smaller than a cross-sectional area thereof positioned inside of the cutting line.

The through-holes are pairs of holes located in line symmetry about the cutting line in the front surface side of the magnetic insulating substrate, and can be oblong holes extending across the cutting line in the back surface side of the magnetic insulating substrate. Each of the external electrodes is surrounded by the magnetic insulating substrate and connects to the connection conductor formed on the side wall of one of the pairs of holes in the front surface side, and connects to the connection conductor formed on the side wall of the oblong hole in the back surface side. Each of the through-holes can be oblong and can extend across the cutting line, and each of the external electrodes connects to the connection conductor formed on the side wall of the oblong hole. The external electrodes can be formed away from the cutting line.

BRIEF DESCRIPTION OF THE DRAWINGS

FIGS. 1A and 1B show a structure of a first embodiment of an inductor according to the present invention, in which FIG. 1A is a plan view of an essential part and FIG. 1B is a sectional view taken along the line 1B-1B of FIG. 1A.

FIGS. 2A, 2B, 2C show a process of fabricating the first embodiment, in which FIG. 2A is a plan view of the ferrite substrate, FIG. 2B is a plan view of the part B of the ferrite substrate of FIG. 2A in which through-holes are formed, and FIG. 2C is a sectional view taken along the line 2C-2C of FIG. 2B.

FIGS. 8A and 8B show a structure of a second embodiment of an inductor according to the present invention, in which FIG. 8A is a plan view of the front side of an essential part and FIG. 8B is a sectional view taken along the line 8B-8B of FIG. 8A.

FIGS. 9A and 9B show different views of the second embodiment, in which FIG. 9A is a plan view of the back side of an essential part and FIG. 9B is a side view taken along the line 9B-9B of FIG. 9A.

FIGS. 10A, 10B, 10C show a process of fabricating the second embodiment, in which FIG. 10A is a plan view of the ferrite substrate, FIG. 10B is a plan view of the front side of the ferrite substrate in which through-holes are formed, and FIG. 10C is a sectional view taken along the line 10C-10C of FIG. 10B.

FIGS. 11A and 11B show a process of fabricating an essential part of the second embodiment following the process of FIGS. 10A, 10B, 10C, in which FIG. 11A is a plan view of the back side of the ferrite substrate in which through-holes are formed and FIG. 11B is a sectional view taken along the line 11B-11B of FIG. 11A.

FIGS. 18A and 18B show a structure of a third embodiment of an inductor according to the present invention, in which FIG. 18A is a plan view of the front side of an essential part and FIG. 18B is a sectional view taken along the line 18B-18B of FIG. 18A.

FIGS. 19A and 19B show different views of the third embodiment, in which FIG. 19A is a plan view of the back side of the essential part and FIG. 14B is a side view of the part taken along the line 19B-19B of FIG. 19A.

FIGS. 20A, 20B, 20C show a process of fabricating the third embodiment, in which FIG. 20A is a plan view of the ferrite substrate, FIG. 20B is a plan view of the front side of the part B of the ferrite substrate in which through-holes are formed, and FIG. 20C is a sectional view taken along the line 20C-20C of FIG. 20B.

FIG. 21 shows a process of fabricating the third embodiment following the process in FIGS. 20A, 20B, 20C, and is an enlarged view of the part C of FIG. 20B on which a plating seed layer is formed.

FIG. 22 shows a process of fabricating an essential part of the third embodiment following the process of FIG. 21, and is a plan view of the front side of the ferrite substrate on which external electrodes, coil conductors, and connection conductors are formed.

FIG. 25 is an enlarged view of the part D of FIG. 24.

FIG. 26 shows a process of fabricating an essential part of the third embodiment following the process of FIGS. 22 and 23 and is a sectional view cut along the scribe line after covering with an epoxy resin.

FIGS. 30A, 30B, and 30C show a structure of a conventional inductor, in which FIG. 30A is a plan view of an essential part, FIG. 30B is a sectional view of an essential part taken along the line 20B-30B of FIG. 30A, and FIG. 30C is a side view of the part A of FIG. 30A.

DETAILED DESCRIPTION

Figure 1A:
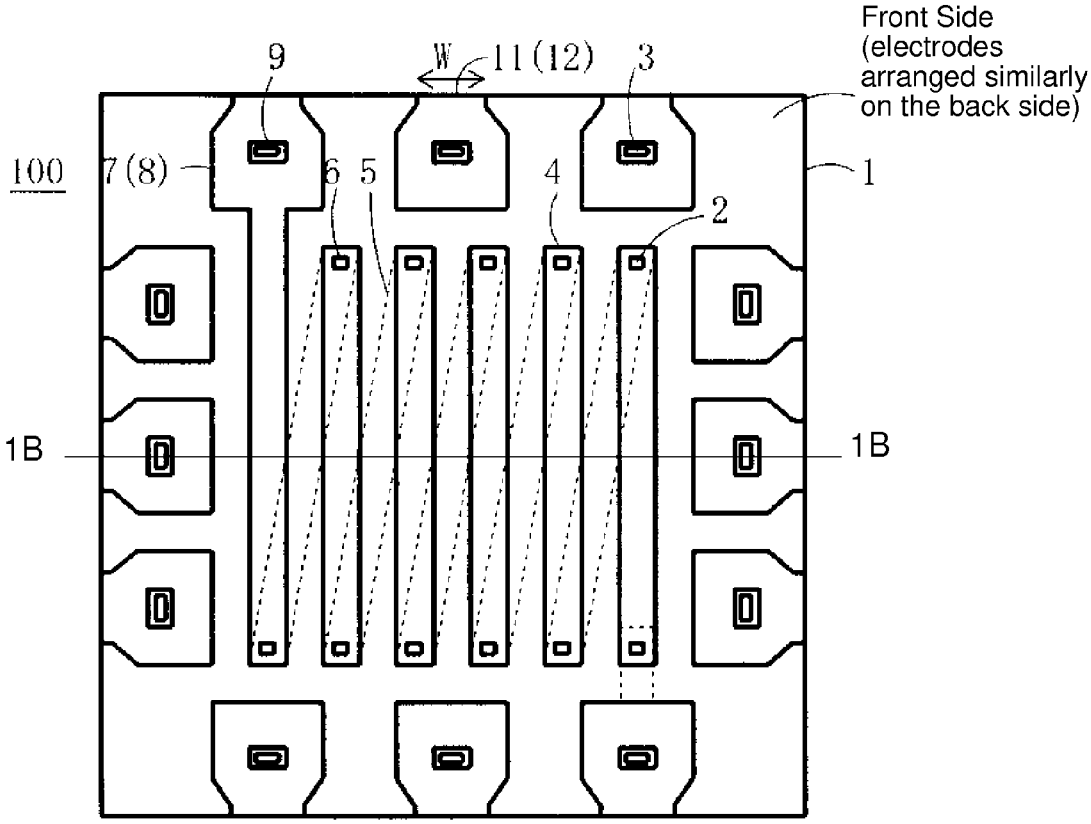
Figure 1B:
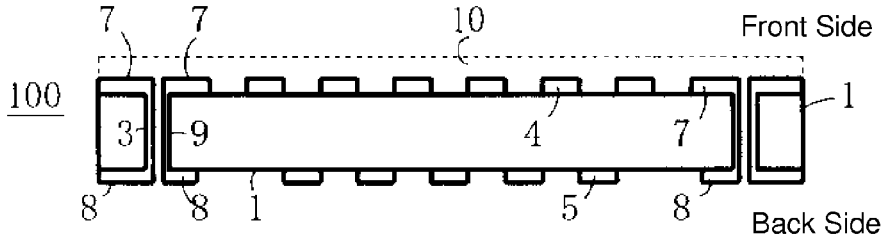

The following describe some preferred embodiments of an inductor according to the present invention. FIGS. 1A and 1B show an inductor 100 according to the first embodiment. The inductor 100 is an example having a solenoid coil, and first and second external electrodes 7, 8 along the four sides of a ferrite substrate 1. The inductor 100 comprises the ferrite substrate 1, first and second coil conductors 4, 5, first connection conductors 6, first and second external electrodes 7, 8, and second connection conductors 9.

The solenoid coil is formed in the central region of the ferrite substrate 1. The external electrodes are formed on the front and back surfaces in the peripheral region of the ferrite substrate 1 around the coil. The coil is composed of the first coil conductor 4 on the front side (also referred to as front surface side) of the ferrite substrate 1, the second coil conductor 5 on the back side (also referred to as back surface side) of the ferrite substrate 1, and the first connection conductors 6 formed on the side wall of first through-holes 2 and connecting the first and second coil conductors 4 and 5. The external electrodes are arranged in the peripheral region of the ferrite substrate 1 surrounding the coil and extend to the edge of the ferrite substrate 1. The external electrodes comprise the first external electrodes 7 formed on the front surface side of the ferrite substrate 1 and the second external electrodes 8 formed on the back surface side of the ferrite substrate 1 at the locations corresponding to the first external electrodes 7. Each of the first external electrodes 7 is connected to the corresponding second external electrode 8 through a second connection conductor 9 formed on a side wall of a second through-hole 3. The ferrite substrate 1 surrounds every first connection conductor 6 and second connection conductor 9. A protective film of epoxy resin 10 or the like covers the first coil conductors 4 and the first external electrodes 7 on the front surface side of the ferrite substrate 1. When a semiconductor chip (not shown in the figures) is mounted on the front surface side of the ferrite substrate 1, the epoxy resin 10 becomes a mold resin covering the ferrite substrate 1 and the semiconductor chip.

To suppress generation of flashes around the first and second external electrodes 7, 8, the width of the external electrodes 7, 8 at the peripheral edge of the ferrite substrate 1 (the width W in FIG. 4 of the external electrodes 7, 8 at the cutting lines 11, 12) is made narrower than the width of the external electrodes 7, 8 extending inside of the ferrite substrate 1. This configuration has been found from extensive studies made by the inventors herein. The principal factor that affects generation of flashes is the cross-sectional area (or the extracted volume) of the cut external electrode, and a smaller cross-sectional area (or a smaller extracted volume) more effectively suppresses the generation of flashes. Therefore, the cross-sectional area (or the extracted volume) of the external electrodes 7, 8 at the peripheral edge of the ferrite substrate 1 is made smaller than the cross-sectional area (or the extracted volume) of the external electrodes 7, 8 extending inside of the ferrite substrate 1.

Although the first and second external electrodes 7, 8 are formed along four sides of the ferrite substrate 1 in the inductor 100 as shown in FIG. 1A, the external electrodes can be formed only along the upper and lower two sides parallel to the coil axis (the line 1B-1B), such as disclosed in co-pending application Ser. No. 11/952,986, the disclosure of which is incorporated herein by reference. In that case, the first and second external electrodes 7, 8 are absent in the left and right two sides orthogonal to the coil axis. Accordingly, those spaces can be utilized for forming coil conductors 4, 5, thereby increasing the number of turns of the coil. The increased number of turns of the coil enhances the inductance of the inductor 100. When the inductor 100 is used discretely, the first and second external electrodes 7, 8 can be simply reduced to two electrodes for connection to the coil.

Next, a method of manufacturing the inductor 100 will be described. FIGS. 2A through 7 illustrate a method of manufacturing the inductor 100 in the order of process sequence. First, a ferrite substrate 1 with an external dimension of 100 mm square and a thickness of 525 μm is provided as shown in FIG. 2A. Note that only one of a plurality of inductors 100 to be fabricated with the ferrite substrate 1 is illustrated. To form through-holes for external electrodes and coils, photolithography is carried out on the front and back surfaces of the ferrite substrate 1 using a photoresist (not shown in the figures) to make a pattern corresponding to the arrangement of through-holes as shown in FIG. 2B. In the patterning process, openings are formed in the photoresist at the positions of the through-holes 2 and 3 in FIG. 2B. As the photoresist needs to exhibit strength to withstand the sandblasting process, a dry film 100 μm thick is used.

Subsequently, a plurality of first through-holes 2 and pairs of second through-holes 3 are formed in the ferrite substrate 1 by means of a sand blasting method as shown in FIGS. 2B and 2C. The first through-holes 2 are provided for forming the first connection conductors 6. The pairs of second through-holes 3 are formed surrounding a coil-forming region 33 that encloses the first through-holes 2. The pairs of second through-holes 3 are arranged in line symmetry with respect to the scribe line 31 indicated by the dotted line, which is a cutting line having a certain cut out width. When the first and second external electrodes 7, 8 are arranged at upper and lower places in a row parallel to the coil axis, the second through-holes 3 are formed only along the upper and lower scribe lines 31 that are parallel to the row of the first through-holes 2. Here, FIG. 2A is a plan view of the whole ferrite substrate 1, FIG. 2B is an enlarged plan view of the part B of FIG. 2A and shows that the region surrounded by the dotted lines of scribe lines 31 becomes an inductor, and FIG. 2C is a sectional view taken along the line 2C-2C of FIG. 2B.

Figure 3:
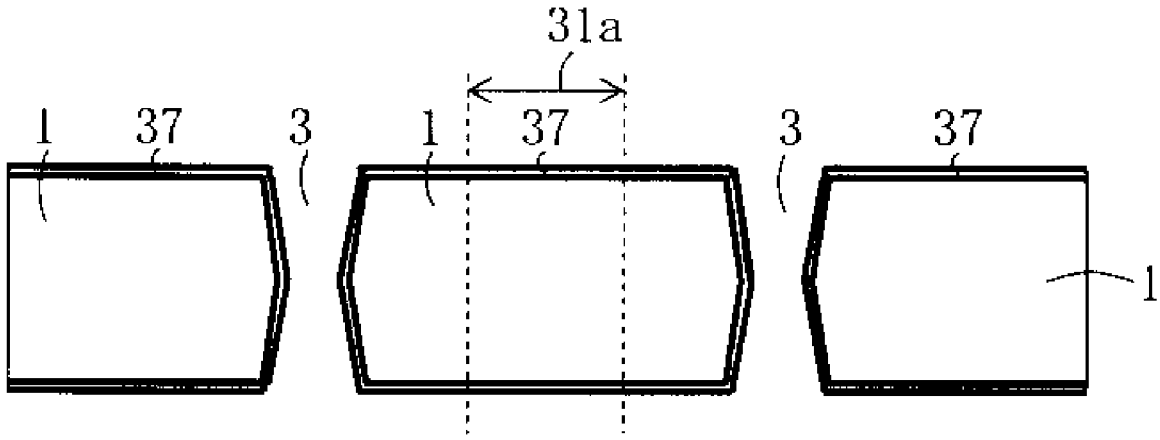
FIG. 3 shows a process of fabricating the first embodiment following the process of FIGS. 2A, 2B, 2C, and is an enlarged view of the part C of FIG. 2C on which a plating seed layer is formed.
Figure 4:
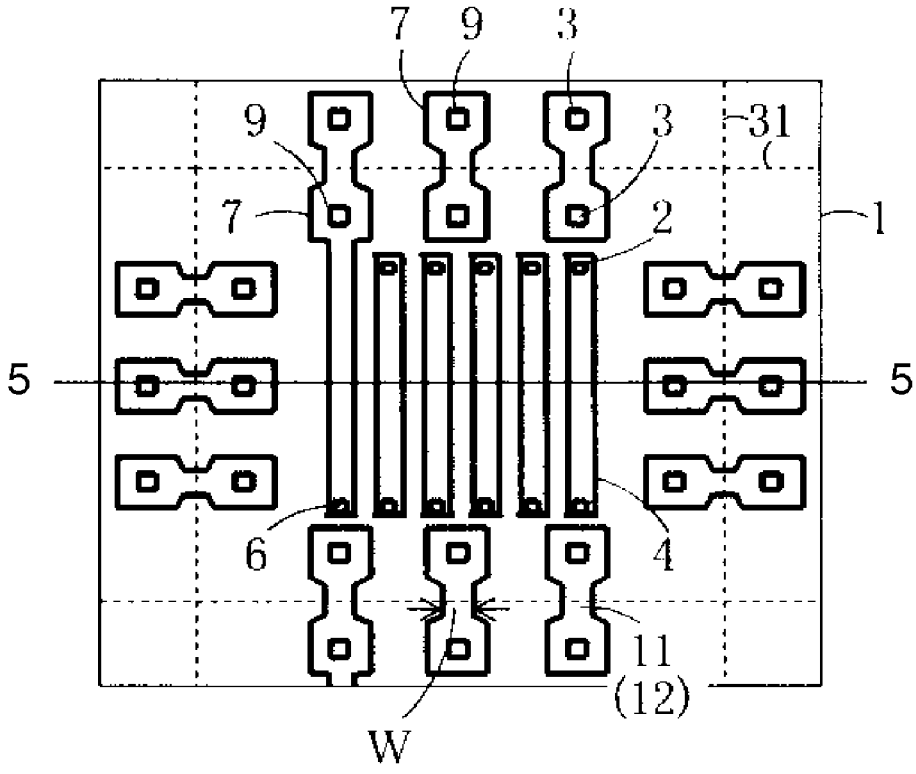
FIG. 4 shows a process of fabricating the first embodiment following the process of FIG. 3, and is a plan view of the ferrite substrate on which external electrodes, coil conductors, and connection conductors are formed.
Figure 5:
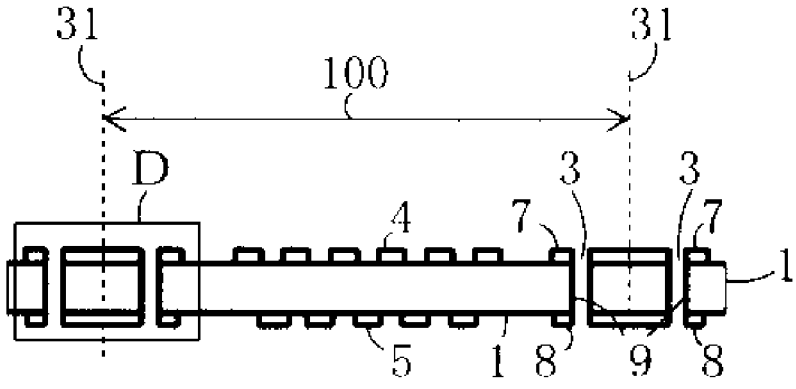
FIG. 5 is a sectional view taken along the line 5-5 of FIG. 4.
Figure 6:
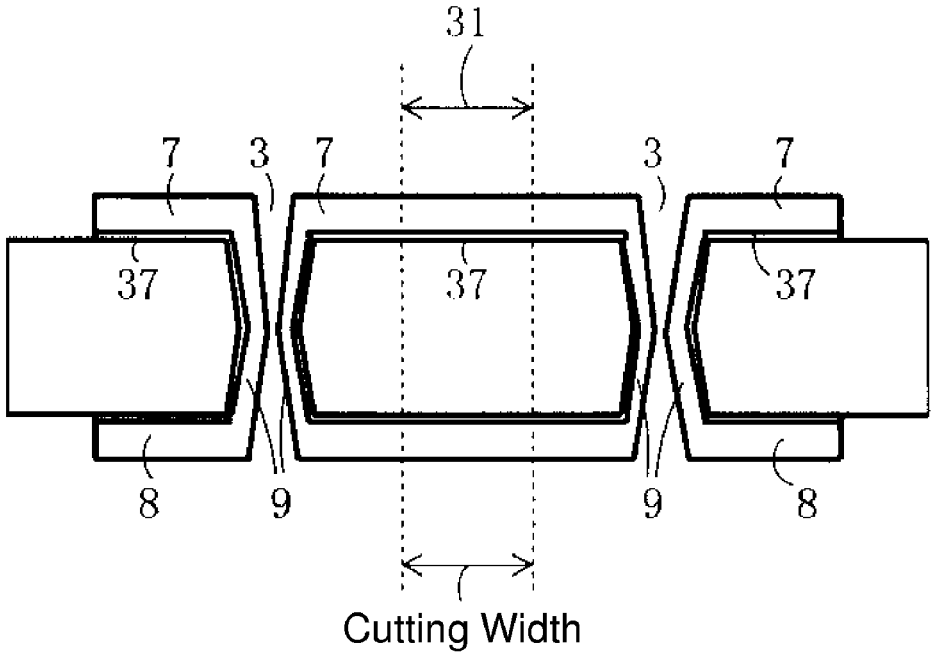
FIG. 6 is an enlarged view of the part D of FIG. 5.

Then, a plating seed layer 37 is formed as shown in FIG. 3 for forming the first and second coil conductors 4, 5, the first and second external electrodes 7, 8, and the first and second connection conductors 6, 9. FIG. 3 is an enlarged view corresponding to the part C of FIG. 2C. Then, the first and second coil conductors 4, 5, the first and second external electrodes 7, 8, and the first and second connection conductors 6, 9 are formed as shown in FIGS. 4, 5 and 6. First, the patterning is carried out by a photolithography method using a dry film (not shown in the figures). In the patterning for forming the first and second external electrodes 7, 8 that are connected to the second connection conductors 9, the openings are formed in the dry film at the places around the second through-holes 3 and at the places connecting the pairs of the second through-holes 3, where the two first external electrodes 7 at both sides of the scribe line 31 are connected and the two second external electrodes 8 at both sides of the scribe line 31 are connected. These connection places of the external electrodes include cutting lines or places 11, 12. The width W of the electrodes 7, 8 at the cutting places 11, 12, which are formed afterward, is made narrow to suppress generation of flashes.

After the patterning in the dry film, a copper film 35 μm to 65 μm thick is formed on the plating seed layer 37 by electroplating. To prevent the thick copper film from corrosion, a corrosion protective film of nickel film 2 μm thick and a gold film 1 μm thick are plated on the thick copper film. Thus, the first and second coil conductors 4, 5, the first and second external electrodes 7, 8, and the first and second connection conductors 6, 9 are formed, each consisting of a plating seed layer 37, a thick copper film, and a corrosion protective film. The width W of the electrodes 7, 8 at the cutting places 11, 12 is narrow by about one half of the width of the wider places thereof. After peeling off the dry film, unnecessary plating seed layer 37 is removed by etching with an agent using the first and second coil conductors 4, 5 and the first and second external electrodes 7, 8 as a mask. Then, the first coil conductors 4 and the first external electrodes 7 formed on the front surface side of the ferrite substrate 1 are covered with an epoxy resin 10.

By reducing the width W of the electrodes 7, 8 at the cutting places 11, 12, generation of flashes at the cutting places 11, 12 of the first and second external electrodes 7, 8 is prevented during the process of cutting the ferrite substrate 1 along the scribe line 31. As described previously, the generation of flashes depends on the cross-sectional area of the cut place and the amount of extracted volume. Therefore, the narrow width of the electrodes 7, 8 at the cutting place prevents the generation of flashes. After preventing the generation of flashes, the solder bridge between adjacent second external electrodes 8 is not formed in the process of soldering the second external electrodes to a packaging substrate (not shown in the figures). Thus, a short-circuiting between the second external electrodes is avoided, improving reliability of the device.

Figure 7:
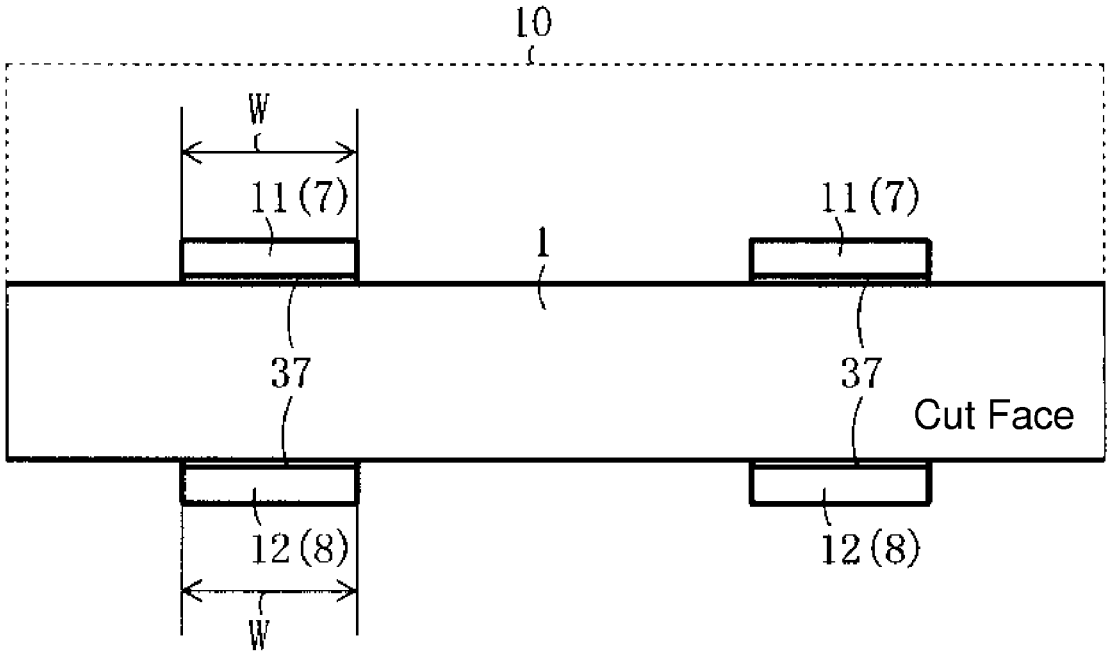
FIG. 7 shows a process of fabricating the first embodiment following the process of FIG. 4, and is a sectional view cut along the scribe line after covering with an epoxy resin.

Then, the ferrite substrate 1 is cut along the scribe line 31 indicated in FIG. 4. FIG. 7 is an enlarged view of the cut plane. The cutting is conducted after coating with a protective film of epoxy resin 10, for example. The flashes may be generated in a place without the coating of epoxy resin 10. Since the second external electrode 8, which is to be soldered to a packaging substrate (not shown in the figures), is not coated with an epoxy resin 10, the width W of the cutting place 12 is made narrow to prevent the generation of flashes. Since the cutting place 11 of the first external electrode 7 is coated and fixed with the epoxy resin 10, the generation of flashes is suppressed even if the cutting place 11 is not narrowed. However, since the generation of flashes can be further prevented when narrowed, the width of the electrodes 7, 8 at the cutting place 11 is made narrow as well as the cutting place 12.

Referring to FIGS. 8A, 8B, 9A, 9B the inductor 200 according to the second embodiment is also an example having a solenoid coil and the first and second external electrodes 7, 8 along the four sides of the ferrite substrate 1. The inductor 200 comprises the ferrite substrate 1, the first and second coil conductors 4, 5, the first connection conductors 6, the first and second external electrodes 7, 8, and the second connection conductors 9. The solenoid coil is also formed in the central region of the ferrite substrate 1. The external electrodes 7, 8 are formed at the peripheral region of the ferrite substrate 1 around the coil. The coil is composed of the first coil conductor 4 on the front side of the ferrite substrate 1, the second coil conductor 5 on the back side of the ferrite substrate 1, and the first connection conductors 6 formed on the side wall of the first through-holes 2, the first connection conductors 6 connecting the coil conductors 4 and 5. The external electrodes are arranged in the peripheral region of the ferrite substrate 1 surrounding the coil. The external electrodes comprise the first external electrodes 7 formed on the front surface side of the ferrite substrate 1 and the second external electrodes 8 formed on the back surface side of the ferrite substrate 1. Each of the first external electrodes 7 is connected to the corresponding second external electrode 8 through the second connection conductor 9 formed on the side wall of the second through-hole 3. The relative magnetic permeability of the ferrite substrate 1 used in this embodiment is about 100. The ferrite substrate 1 surrounds the first external electrode 7. The second external electrode 8 extends to the edge of the ferrite substrate 1 and has a narrow width W in the portion near the edge (a cutting place 12).

The ferrite substrate 1 surrounds the first connection conductor 6 as shown in FIG. 8A. The second connection conductor 9 is surrounded by the ferrite substrate 1 in the front side as shown in FIGS. 8A and 8B, while in the back side, is exposed to the side face of the ferrite substrate 1 as shown in FIGS. 8B, 9A, 9B. Of the second connection conductor 9, the upper half in the thickness direction of the ferrite substrate 1 is formed within the ferrite substrate 1, while the lower half is exposed to the side face of the ferrite substrate 1. The relative magnetic permeability of the ferrite substrate 1 is 100, that of the second connection conductor 9 exposed sideway and composed of copper is one, and that of the side space opened to the air is one. A magnetic flux passes through a high relative magnetic permeability substance or a substance of a low magnetic resistance, that is, through the ferrite substrate 1. Consequently, in the lower half of the ferrite substrate 1, no magnetic flux runs outside the second external electrode 8 and the second connection conductor 9. In the upper half of the ferrite substrate 1, the magnetic flux running outside the first external electrode 7 and the second connection conductor 9 undergoes an increased magnetic resistance due to the halved thickness of the ferrite substrate 1, and the magnetic flux is reduced as compared with the case of the inductor 100 of the first embodiment. Therefore, the electromotive force induced between the first external electrode 7 and the second external electrode 8 decreases, reducing electromagnetic noises.

Because the width W of the second external electrode 8 is reduced at the cutting place 12, the generation of flashes at the cutting place 12 of the second external electrode 8 is prevented in the process of cutting the whole ferrite substrate 1 having a multiple of inductors 200 along the scribe line 31. By preventing the generation of flashes, the solder bridge between adjacent second external electrodes 8 is not formed in the process of soldering the second external electrodes to a packaging substrate (not shown in the figures). Therefore, a short-circuiting between the second external electrodes 8 is avoided, improving reliability of the device.

Although the first and second external electrodes 7, 8 are formed along four sides of the ferrite substrate 1 in the inductor 200 as shown in FIG. 8A, the external electrodes can be formed only along the upper and lower two sides parallel to the coil axis (the line 8B-8B). In that case, the first and second external electrodes 7, 8 are not present in the left and right two sides orthogonal to the coil axis. Accordingly, those spaces can be utilized for forming coil conductors 4, 5, thereby increasing the number of turns of the coil. The increased number of turns of the coil enhances the inductance of the inductor 200. When the inductor 200 is used discretely, the first and second external electrodes 7, 8 can be simply reduced to two electrodes for connection to the coil.

FIGS. 10A through 17 illustrate a method of manufacturing the inductor 200 of the second embodiment in the order of process sequence. First, a ferrite substrate 1 with an external dimension of 100 mm square and a thickness of 525 μm is provided. In order to form through-holes for external electrodes and coils, photolithography is carried out on the front and back surfaces of the ferrite substrate 1 using a photoresist (not shown in the figures) to make a pattern corresponding to the arrangement of through-holes as shown in FIG. 10B and FIG. 11A, the latter being described later. Openings are formed in the photoresist at the locations denoted as 32, 34, 35, 36 in FIG. 10B and FIG. 11A. Again, as the photoresist needs to exhibit strength to withstand the sandblasting process, a dry film 100 μm thick is used.

Subsequently, as shown in FIGS. 10B and 10C, a plurality of first holes 32 for forming the first connection conductors 6 and a plurality of pairs of second holes 34 outside the coil-forming region 33 including the first holes 32 are dug from the front surface of the ferrite substrate 1 down to the depth more than one half the thickness of the ferrite substrate 1 by means of a sandblasting method. The pairs of second holes 34 are arranged in line symmetry with respect to the scribe line 31 indicated by a dotted line.

Then, as shown in FIGS. 11A and 11B, a plurality of third holes 35 surrounded by the ferrite substrate 1 and fourth holes 36 (oblong holes) with a configuration of an oblong slit stretching over the pair of second holes 34 are dug from the back surface of the ferrite substrate 1 down to the depth reaching the bottom of the first hole 32 and the bottom of the second hole 34 by means of a sandblasting method. Thus, the first and second through-holes 2, 3 are formed. The first through-holes 2 are not shown in FIG. 11B. If the depth of the fourth hole 36 is too deep, breakage may occur at the cut surface in the process of cutting the ferrite substrate along the scribe line 31. Accordingly, the thickness of the ferrite substrate 1 remaining after digging the second hole 34 is preferably at least 200 μm. The thickness is equal to the original thickness of the ferrite substrate subtracted by the depth of the fourth hole 36 dug by sandblasting.

When the first and second external electrodes 7, 8 are formed only along the upper and lower sides parallel to the coil axis of the ferrite substrate, the second holes 34 and the fourth holes 36 consisting of the second through-holes 3 are formed only along the upper and lower two scribe lines 31 parallel to the row of the first through-holes 2.

Figure 12:
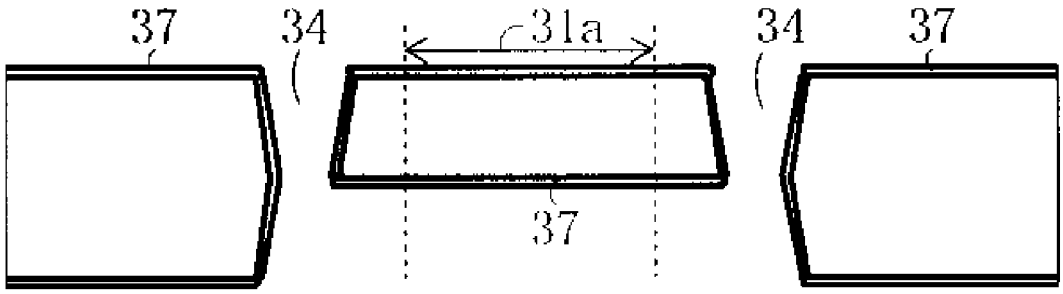
FIG. 12 shows a process of fabricating an essential part of the second embodiment following the process of FIGS. 11A, 11B, and an enlarged view of the part C of FIG. 11B on which a plating seed layer is formed.
Figure 13:
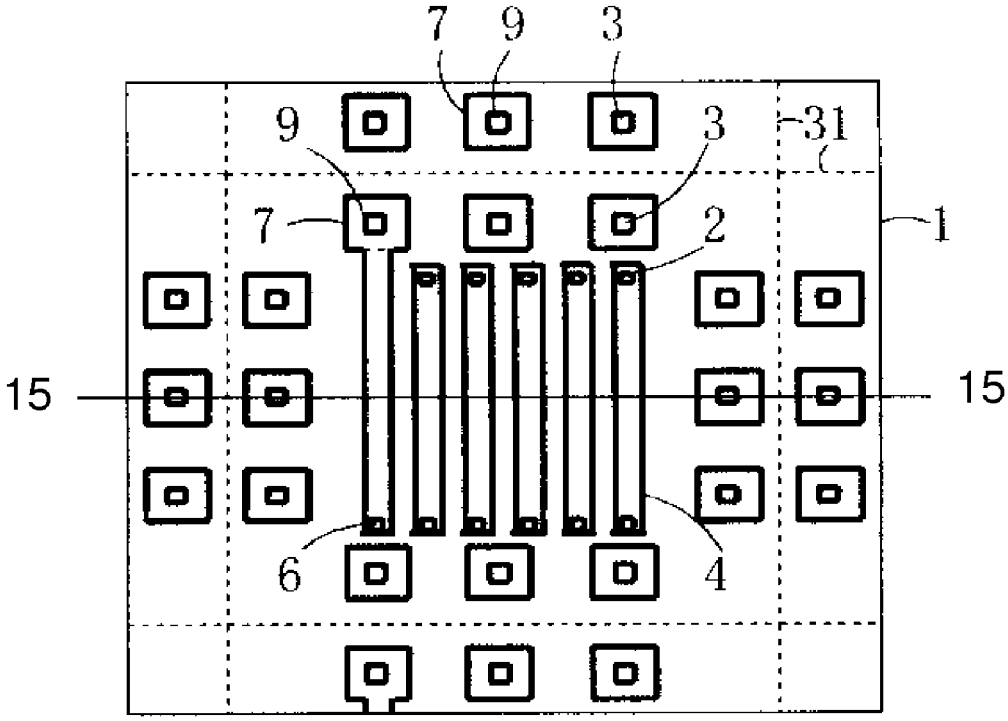
FIG. 13 shows a process of fabricating an essential part of the second embodiment following the process of FIG. 12, and is a plan view of the front side of the ferrite substrate on which external electrodes, coil conductors, and connection conductors are formed.
Figure 14:
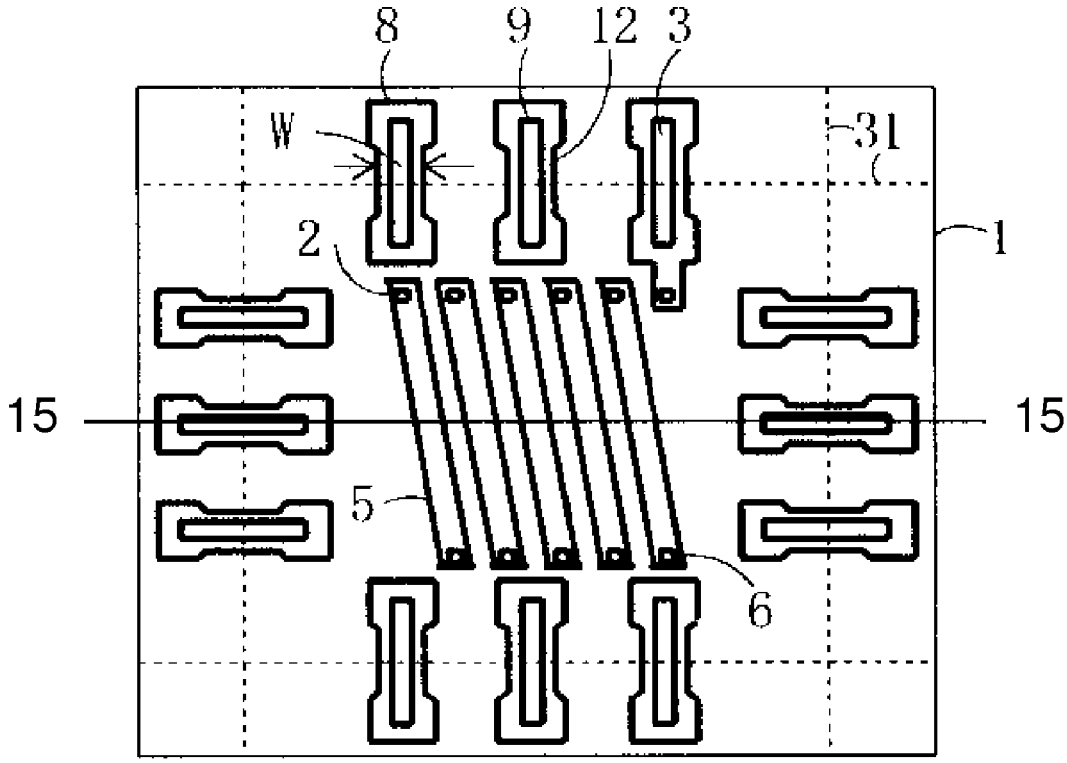
FIG. 14 shows a process of fabricating an essential part of the second embodiment following the process of FIG. 12, and is a plan view of the back side of the ferrite substrate on which external electrodes, coil conductors, and connection conductors are formed.

Then, as shown in FIG. 12, after peeling off the photoresist (not shown in the figure) and cleaning the substrate, a plating seed layer 37 of a titanium film 0.1 μm thick and a copper film 1 μm thick on the titanium film is formed on the front and back surfaces of the ferrite substrate 1 and on the side surface of the first and second through-holes 2, 3 by evaporation or sputtering. The plating seed layer 37 also can be formed of a copper film 1 μm thick by electroless copper plating. Here, FIG. 12 is an enlarged view corresponding to the part C in FIG. 11B.

Then, the first and second coil conductors 4, 5, the first and second external electrodes 7, 8, and the first and second connection conductors 6, 9 are formed as shown in FIGS. 13, 14, 15, and 16. First, patterning is carried out by a photolithography method using a dry film (not shown in the figures). In the patterning for forming the first and second external electrodes 7, 8 that are connected to the second connection conductors 9, the openings are formed in the dry film around the second holes 34 in the front surface side and around the fourth holes 36 in the back surface side. After that, a copper film 35 μm to 65 μm thick is formed on the plating seed layer 37 by electroplating. To prevent the thick copper film from corrosion, a corrosion protective film of a nickel film 2 μm thick and a gold film 1 μm thick are plated on the thick copper film. Thus, the first and second coil conductors 4, 5, the first and second external electrodes 7, 8, and the first and second connection conductors 6, 9 are formed, each comprising a plating seed layer 37, a thick copper film, and a corrosion protective film. The first external electrode 7 is surrounded by the ferrite substrate 1. The second external electrode 8 formed across the scribe line 31 has a width at the cutting place made thinner. Subsequently, after peeling off the dry film, unnecessary plating seed layer 37 is removed by etching with an agent using the first and second coil conductors 4, 5 and the first and second external electrodes 7, 8 as a mask. Again, a plurality of inductors 200 can be fabricated with the ferrite substrate 1, after covering the front side with an epoxy resin 10.

Figure 15:
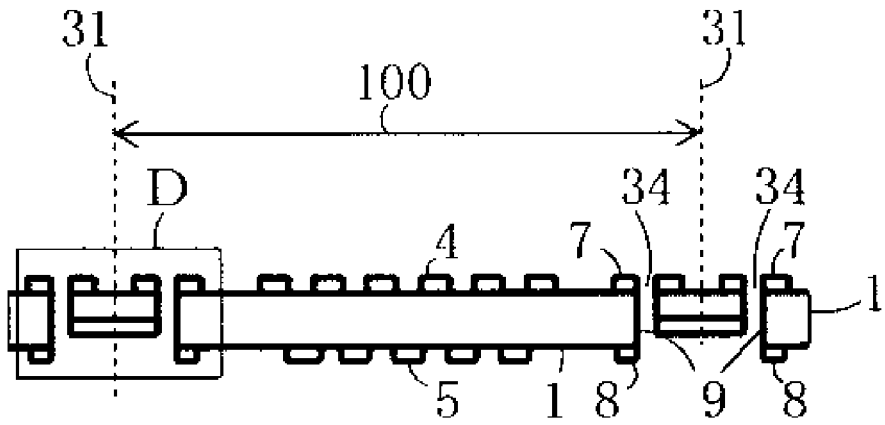
FIG. 15 is a sectional view taken along the line 15-15 of FIGS. 13 and 14.

Then, the ferrite substrate 1 is cut along the scribe or cutting line 31 indicated by a dotted line that runs through the middle region between a pair of the second holes 34, the region being off the first external electrodes 7 as shown in FIG. 15. After the cutting process as shown by the cut surface in FIG. 17, the edge of the ferrite substrate is the ferrite substrate 1 in the front side, while in the back side, the second connection conductor 9 is exposing at the side face of the ferrite substrate 1. Thus, the inductor 200 of the second embodiment as shown in FIGS. 8A, 8B, 9A, 9B is completed.

Figure 16:
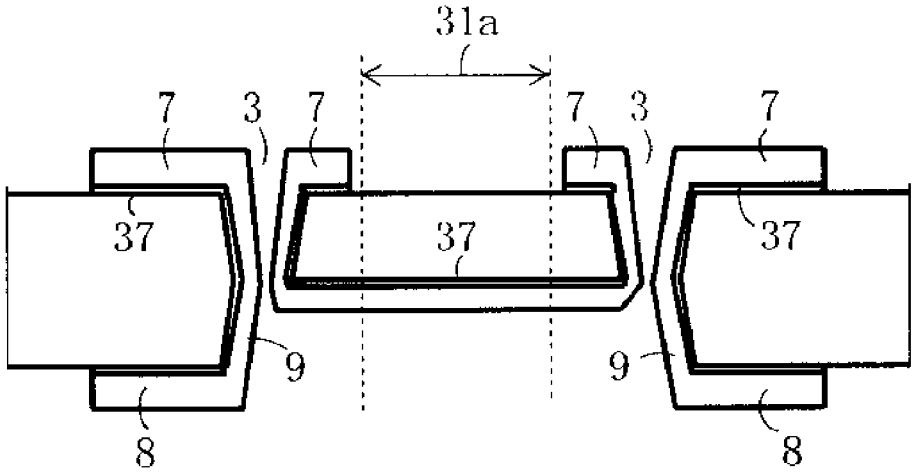
FIG. 16 is an enlarged view of the part D of FIG. 15.
Figure 17:
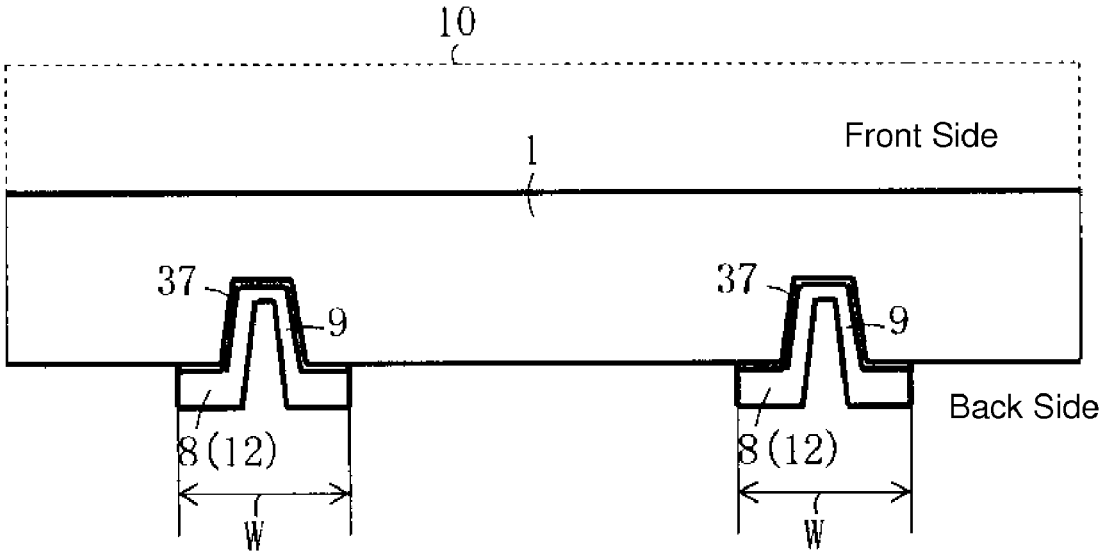
FIG. 17 shows a process of fabricating an essential part of the second embodiment following the process of FIGS. 13 and 14, and is a sectional view cut along the scribe line after covering with an epoxy resin.

The width 31*a* of the scribe line (a width cut off by a cutter) shown in FIG. 16 is narrower than the distance between adjacent first external electrodes 7 in the front surface side of the ferrite substrate 1, so that the cutter does not cut the first external electrode 7. In the back surface side, the width W of the second external electrode 8 at the cutting place 12 is made narrower so that generation of flashes from the second external electrode 8 is prevented in the cutting process.

Figure 18A:
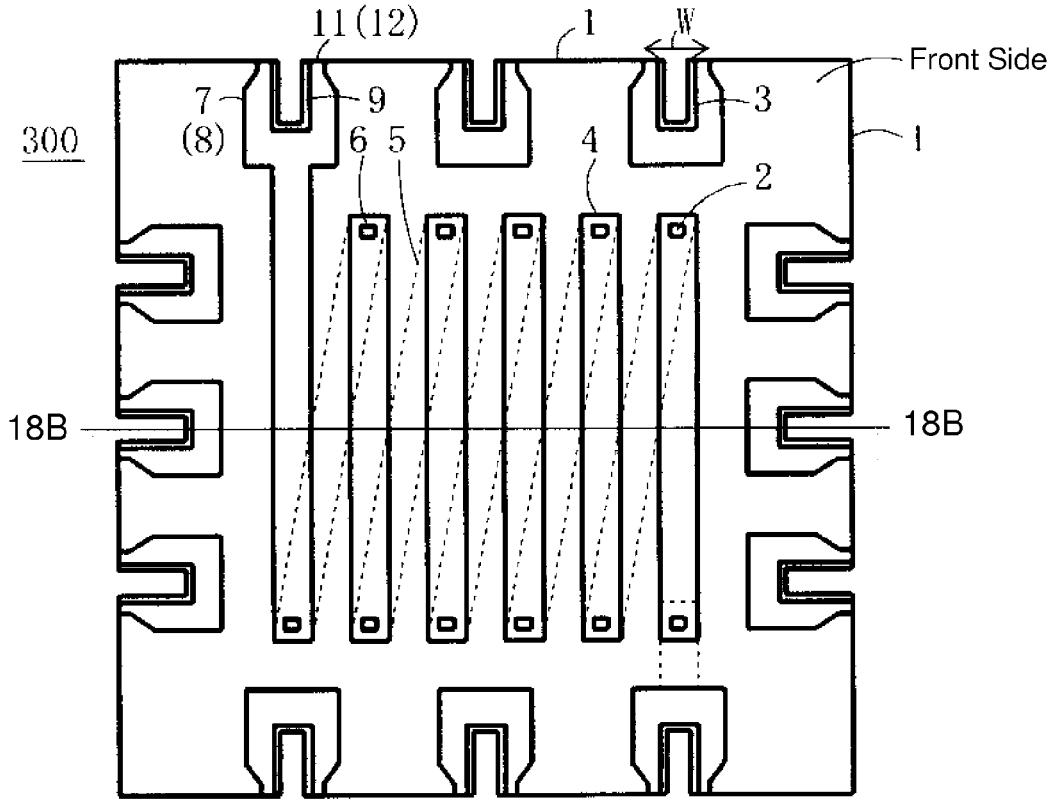
Figure 18B:
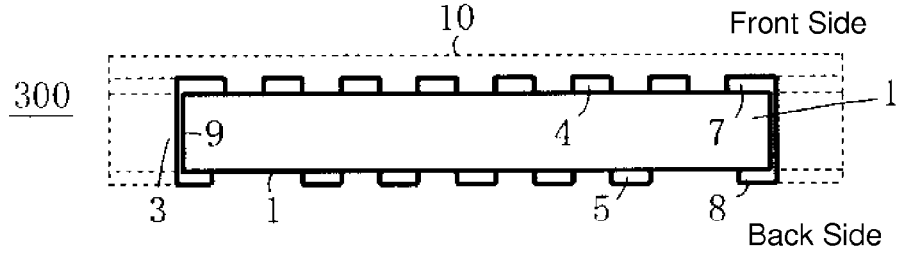
Figure 19A:
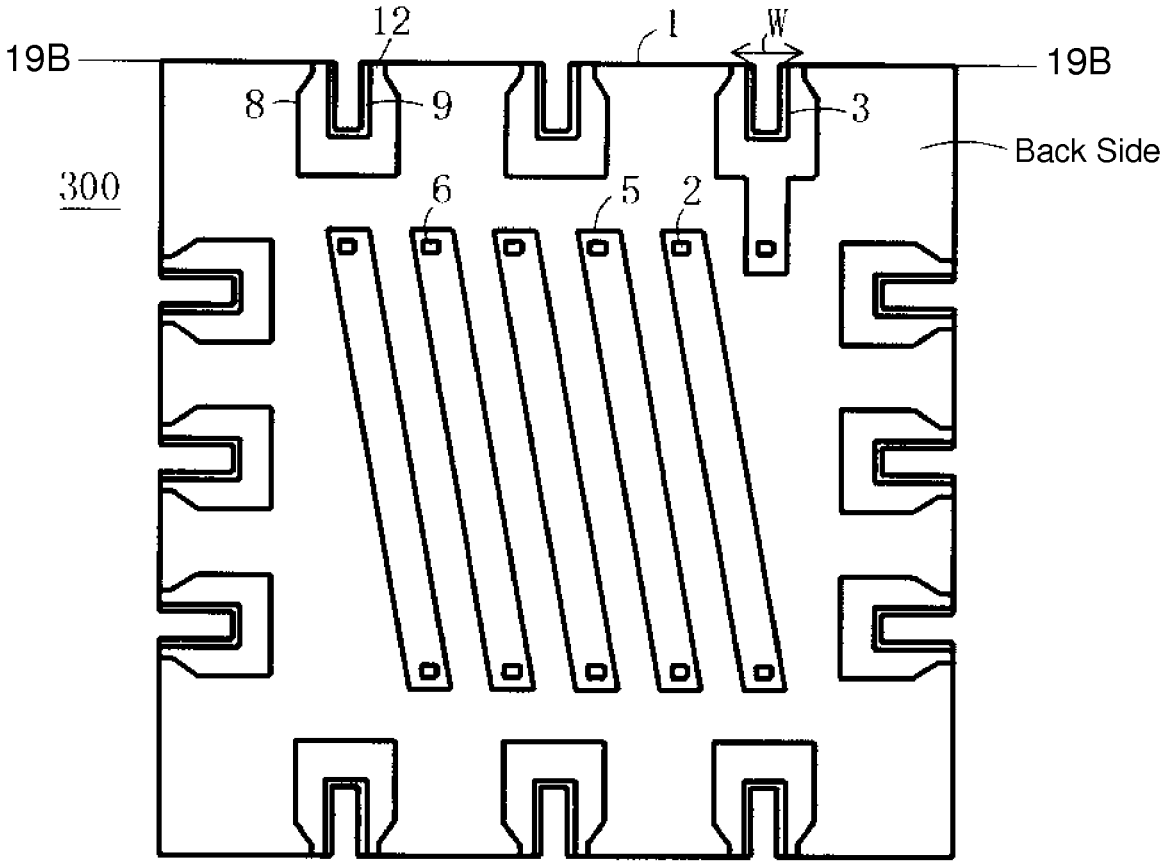
Figure 19B:
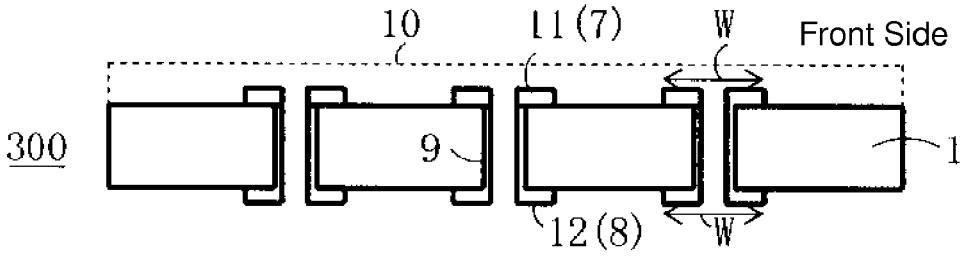
Figure 23:
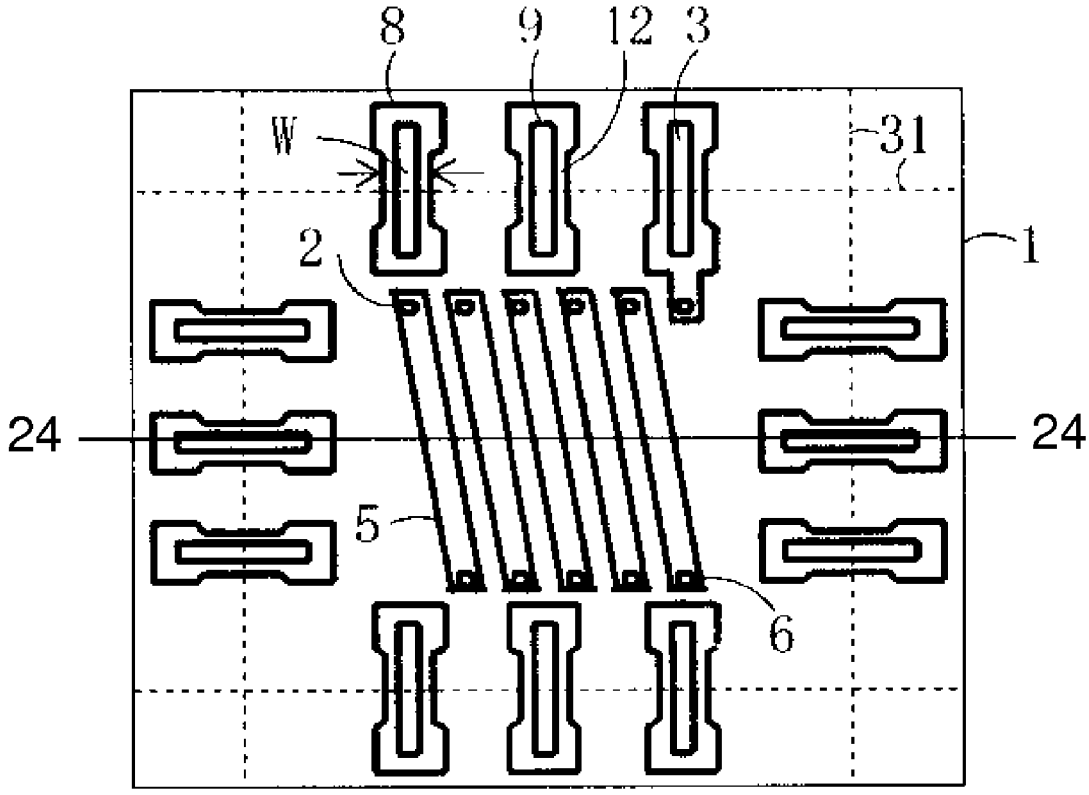
FIG. 23 shows a process of fabricating an essential part of the third embodiment following the process of FIG. 21, and is a plan view of the back side of the ferrite substrate on which external electrodes, coil conductors, and connection conductors are formed.
Figure 24:
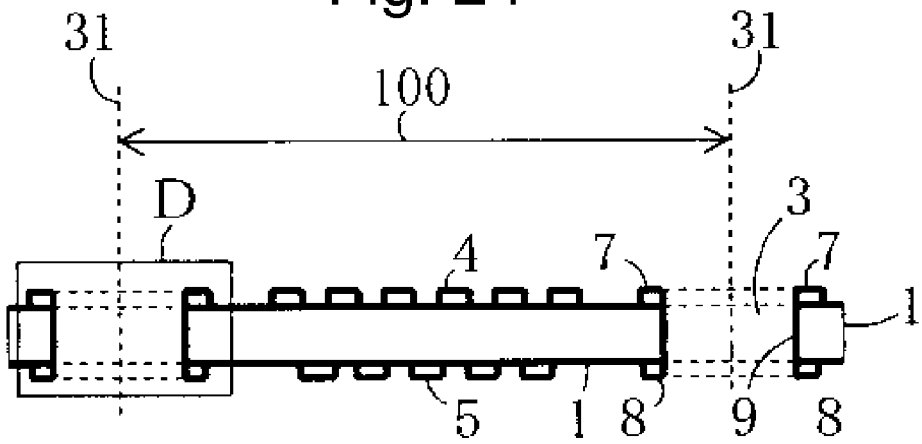
FIG. 24 is a sectional view taken along the line 24-24 of FIGS. 22 and 23.

FIGS. 18A, 18B, 19A, 19B illustrate the inductor 300 according to the third embodiment. The upper sides in the sectional view of FIG. 18B and the side view of FIG. 19B are the front sides, and the lower sides are the back sides. This inductor 300 is also an example having a solenoid coil and the first and second external electrodes 7, 8 along the four sides of the ferrite substrate 1. The inductor 300 comprises a ferrite substrate 1, the first and second coil conductors 4, 5, the first connection conductors 6, the first and second external electrodes 7, 8, and the second connection conductors 9. The solenoid coil is formed in the central region of the ferrite substrate 1. The external electrodes are formed in the peripheral region of the ferrite substrate 1 around the coil. The coil is composed of the first coil conductor 4 on the front side of the ferrite substrate 1, the second coil conductor 5 on the back side of the ferrite substrate 1, and the first connection conductors 6 formed on the side wall of the first through-holes 2 and connecting the coil conductors 4 and 5. The external electrodes are arranged in the peripheral region of the ferrite substrate 1 surrounding the coil. The external electrodes comprise the first external electrodes 7 formed on the front surface side of the ferrite substrate 1 and the second external electrodes 8 formed on the back surface side of the ferrite substrate 1. Each of the first external electrodes 7 is connected to the corresponding second external electrode 8 through the second connection conductor 9 formed on the side wall of the second through-hole 3.

The second connection conductors 9 are exposed to the environment at the side face of the ferrite substrate 1 as shown in FIGS. 18A, 18B, 19A, 19B. The first and second external electrodes 7, 8 extend to the edge of the ferrite substrate 1 and have a narrower width W in the portion near the edge (the cutting places 11, 12). The relative magnetic permeability of the ferrite substrate 1 is 100, that of the second connection conductor 9 exposed sideway and composed of copper is one, and that of the side space opened to the air is one. The magnetic flux passes through a high relative magnetic permeability substance or a substance of a low magnetic resistance, that is, through the ferrite substrate 1. Consequently, no magnetic flux runs outside the first and second external electrodes 7, 8 and the second connection conductor 9. As a result, the magnetic flux that generates electromotive force between the first and second external electrodes is smaller than in the inductor 200 of the second embodiment. Therefore, further noise reduction is achieved.

By narrowing the width W of the first and second external electrodes 7, 8 at the cutting places 11, 12, the generation of flashes is prevented. By preventing the generation of flashes, the solder bridge between adjacent second external electrodes 8 is not formed in the process of soldering the second external electrodes to a packaging substrate (not shown in the figures). Therefore, a short-circuiting between the second external electrodes is avoided, improving reliability of the device.

Although the first and second external electrodes 7, 8 are formed along four sides of the ferrite substrate 1 in the inductor 300, the external electrodes can be formed only along the upper and lower two sides parallel to the coil axis (the line 18B-18B). In that case, the first and second external electrodes 7, 8 are not present in the left and right two sides orthogonal to the coil axis. Accordingly, those spaces can be utilized for forming coil conductors 4, 5, increasing the number of turns of the coil. The increased number of turns of the coil enhances the inductance of the inductor 300. When the inductor 300 is used discretely, the first and second external electrodes 7, 8 can be simply reduced to two electrodes for connection to the coil.

A method of manufacturing the inductor 300 of the third embodiment is described below referring to FIGS. 20A through 27, which illustrate the manufacturing method in the order of process sequence. A ferrite substrate 1 with an external dimension of 100 mm square and a thickness of 525 μm is provide as shown in FIG. 20A. First, a multiple of first through-holes 2 are formed for forming the first connection conductors 6 that electrically connect the first and second coil conductors 4, 5 to be formed on the front and back surfaces of the ferrite substrate 1. The second through-holes 3 for forming the second connection conductors 9 that connect the first external electrodes 7 on the front surface side and the second external electrodes 8 on the back surface side are formed in an oblong configuration across a scribe line. When the first and second external electrodes 7, 8 are only formed along an upper row and a lower row parallel to the coil axis, the second through-holes 3 are only formed around the upper and lower scribe lines 31 parallel to the rows of the first through-holes 2.

Then, as shown in FIG. 21, a plating seed layer 37 is formed for forming the first and second external electrodes 7, 8, the first and second coil conductors 4, 5, and the first and second connection conductors 6, 9. Then, as shown in FIGS. 22, 23, 24, and 25, the first and second external electrodes 7, 8, the first and second coil conductors 4, 5, and the first and second connection conductors 6, 9 are formed by electroplating as in the first and second embodiments. Here, the length L (a design value, FIG. 22) of the narrow portion of the first and second external electrodes 7, 8 at the cutting place (where the width is about half that in the wide portion of the external electrodes) is set at a larger value than the width 31*a* at the cutting places 11, 12 (about 100 μm). By this means, generation of flashes is prevented in the cut face of the second external electrode 8, which is not covered with the epoxy resin 10.

Figure 27:
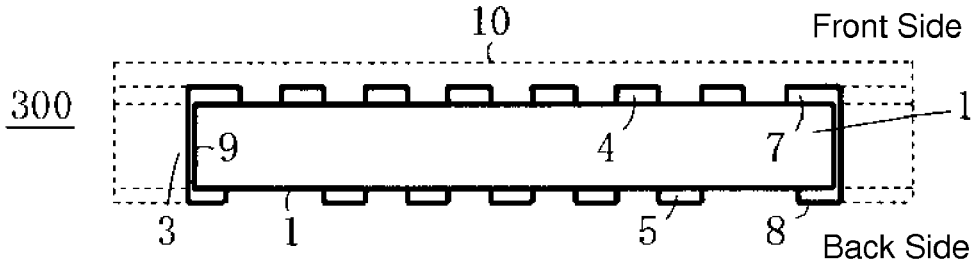
FIG. 27 is a sectional view of the third embodiment formed after the cutting process.

Then, as shown in FIG. 26, after covering the surface of the substrate with the epoxy resin 10, the ferrite substrate 1 and the first and second external electrodes 7, 8 at the cutting places 11, 12 are cut along the scribe line 31 indicated in FIG. 22. One piece of the cut ferrite substrate 1 is the inductor 300 as shown in FIG. 27. As shown in FIGS. 18A and 19A, the first and second external electrodes 7, 8 are narrowed at the edge of the ferrite substrate 1 (to the width W of the external electrodes 7, 8 at the cutting places 11, 12). By this means, generation of flashes is prevented in the cut face at the cutting place 12 of the second external electrode 8.

Figure 28:
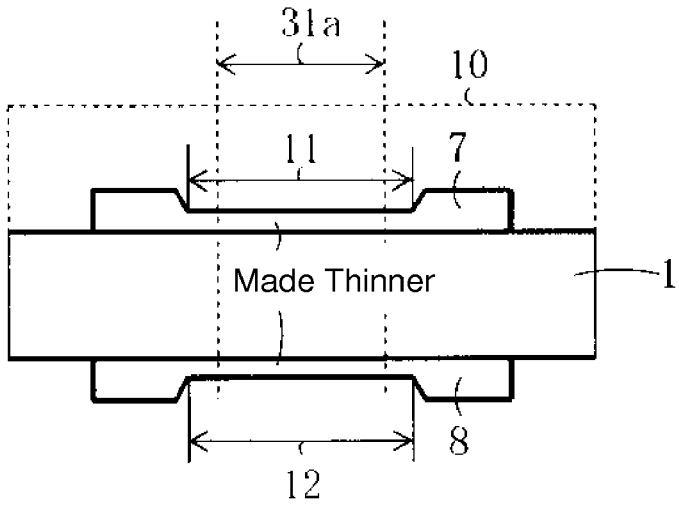
FIG. 28 is a sectional view showing a case of a reduced thickness at the cutting place.

In the first, second, and third embodiments, when the thickness of the first and second external electrodes 7, 8 is reduced at the cutting places 11, 12 as shown in FIG. 28, the generation of flashes is further suppressed. When the thickness of the external electrodes 7, 8 is reduced at the cutting places 11, 12, generation of flashes is prevented even if the width W of the external electrodes 7, 8 at the cutting places 11, 12 is equal to the width of the external electrodes 7, 8 in the inner region of the ferrite substrate 1.

Figure 29:
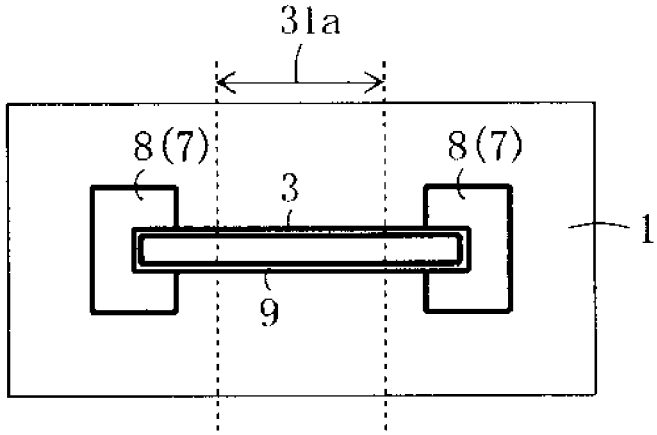
FIG. 29 is a plan view showing a case in which external electrodes are formed in separation from the scribe line.
Figure 30A:
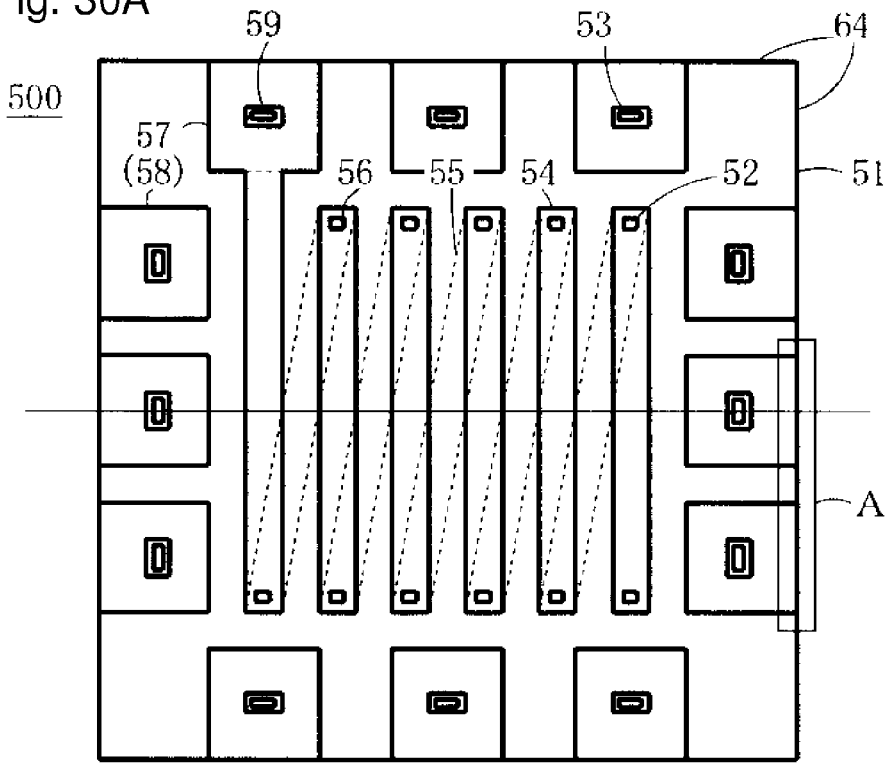
Figure 30B:
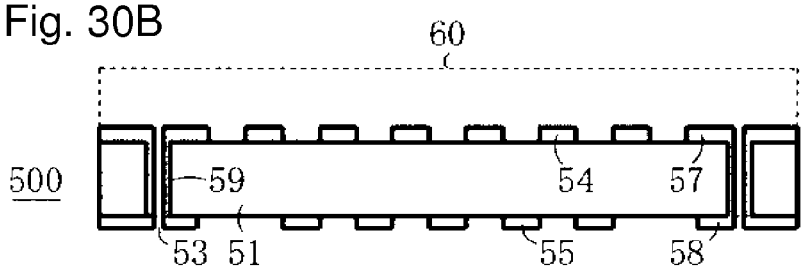
Figure 30C:
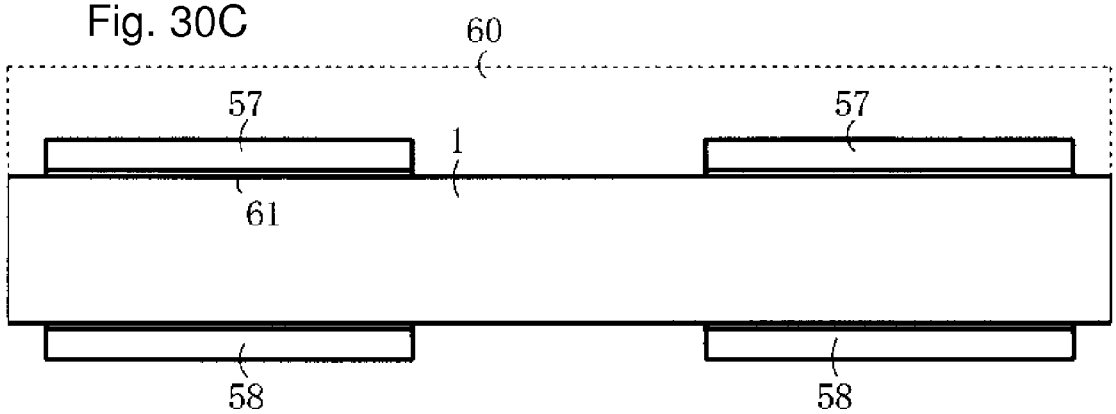
Figure 31:
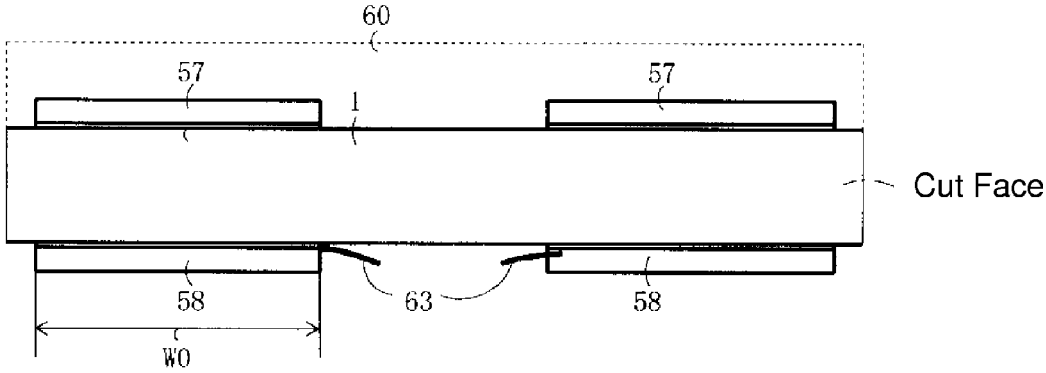
FIG. 31 shows a situation in which flashes are generated.
Figure 32:
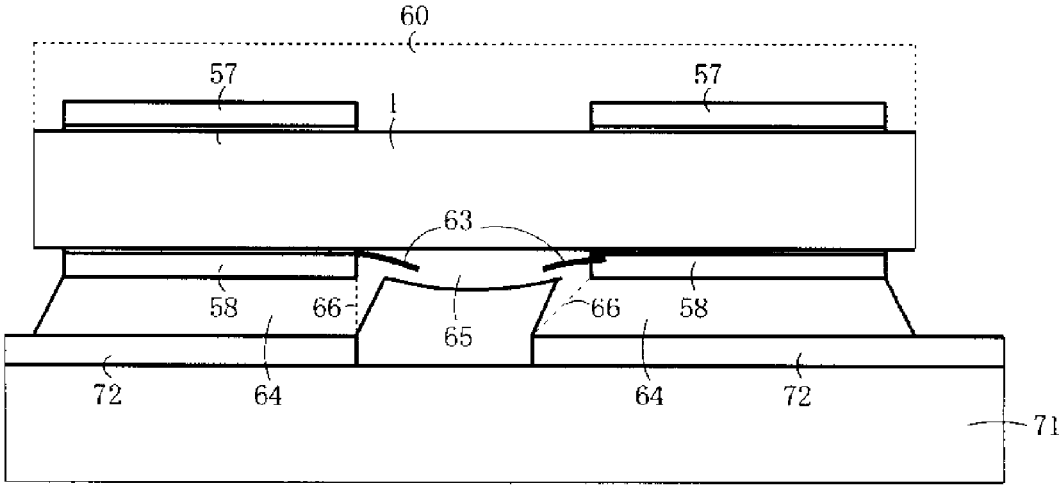
FIG. 32 shows a situation in which a solder bridge is formed.

In the second and third embodiment, when cutting places 11, 12 are eliminated from the external electrodes 7, 8 as shown in FIG. 29, the cutting action is carried out in the ferrite substrate 1 off the first and second external electrodes 7, 8. As a result, the generation of flashes is prevented. The elimination of cutting places in an inductor similar the first embodiment has been disclosed in prior art. Accordingly, such means is applicable to the second and third embodiments.

Although the description is made on the cases without a semiconductor chip on the front surface side of the inductors 100, 200, and 300, in the case with a semiconductor chip mounted on the inductor, the semiconductor chip and the inductor are covered with a epoxy resin 10 and then, the first and second external electrodes 7, 8, the ferrite substrate 1, and the epoxy resin 10 are cut.

The starting ferrite substrate 1 need not be square. It can have a disk shape. The first and second through-holes 2, 3 can be formed by laser machining. In that case, the photolithography that is needed in the case using a dry film becomes no longer necessary, simplifying the process. In the cutting process along the scribe or cutting line, a narrower cutting width means a smaller cut off volume, which further suppresses the generation of flashes. Accordingly, the edge of a cutter is preferably thin.

A microminiature power converter can be produced using an inductor 100, 200, or 300 through processes of fixing a semiconductor chip (not shown in the figures) to the first external electrodes 7 through stud bumps, filling the gap with an underfill resin, covering with an epoxy resin to form a resin mold, cutting along the scribe line 31 to form a module, and fixing the module together with a capacitor and other parts to a packaging substrate.

When the inductor 100, 200, or 300 is used as a discrete part without a semiconductor chip, the semiconductor chip and other parts can be separately mounted on a packaging substrate. Although the inductors 100, 200, and 300 are examples having a solenoid coil, it is possible for an inductor to have a spiral coil or a toroidal coil, the latter being a ring-shaped endless solenoid coil. Although the first and second external electrodes 7, 8 are formed arranging along the four peripheral sides of the ferrite substrate 1 in the inductors 100, 200, and 300, the external electrodes can of course be formed arranging along one, two, or three peripheral sides.

While the present invention has been particularly shown and described with reference to particular embodiments, it will be understood by those skilled in the art that the foregoing and other changes in form and details can be made therein without departing from the spirit and scope of the present invention. All modifications and equivalents attainable by one versed in the art from the present disclosure within the scope and spirit of the present invention are to be included as further embodiments of the present invention. The scope of the present invention accordingly is to be defined as set forth in the appended claims.

This application is based on, and claims priority to, Japanese Patent Application No. 2006-340253, filed on 18 Dec. 2006. The disclosure of the priority application, in its entirety, including the drawings, claims, and the specification thereof, is incorporated herein by reference.

What is claimed is:

1. An inductor comprising:

a magnetic insulating substrate;

a coil in a central region of the magnetic insulating substrate; and external electrodes on front and back surfaces in a peripheral region of the magnetic insulating substrate, wherein each pair of the external electrodes on the first and back surfaces are electrically connected with each other, wherein at least one of the external electrodes on the front surface or on the back surface has a portion that extends to a peripheral edge of the magnetic insulating substrate, and wherein a cross-sectional area of the portion of the one external electrode at the peripheral edge is smaller than a cross-sectional area thereof positioned inside of the peripheral edge of the magnetic insulating substrate.

2. The inductor according to claim 1, wherein a width or thickness of the portion of the one external electrode at the peripheral edge is smaller than a width or thickness thereof positioned inside of the magnetic insulating substrate.

3. The inductor according to claim 1, wherein the coil is a solenoid coil, a spiral coil, or a toroidal coil.

4. The inductor according to claim 2, wherein the coil is a solenoid coil, a spiral coil, or a toroidal coil.

5. The inductor according to claim 1, wherein the magnetic insulating substrate is a ferrite substrate.

6. The inductor according to claim 2, wherein the magnetic insulating substrate is a ferrite substrate.

7. The inductor according to claim 3, wherein the magnetic insulating substrate is a ferrite substrate.

8. A method of manufacturing an inductor comprising a magnetic insulating substrate, a coil formed in a central region of the magnetic insulating substrate, and external electrodes on front and back surfaces in a peripheral region of the magnetic insulating substrate, wherein each pair of the external electrodes on the first and back surfaces being electrically connected with each other, the method comprising the steps of:

forming pairs of through-holes at positions in line symmetry about a cutting line;

forming a connection conductor on a side wall of each of the through-holes and the external electrodes on the front and back surfaces of the magnetic insulating substrate, with the connection conductor connecting each of the pairs of external electrodes;

forming the coil in the coil-forming region inside the cutting line; and cutting the external electrodes and the magnetic insulating substrate along the cutting line, wherein at least one of the external electrodes on the front or back surface has a portion crossing the cutting line, and wherein a cross-sectional area of the portion at the cutting line is smaller than a cross-sectional area thereof positioned inside of the cutting line.

9. The method of manufacturing an inductor according to claim 8, wherein a width or thickness of the portion at the cutting line is smaller than a width or thickness thereof positioned inside of the cutting line.

10. The method of manufacturing an inductor according to claim 8, wherein:

the through-holes are pairs of holes located in line symmetry about the cutting line in the front surface side of the magnetic insulating substrate, and oblong holes extending across the cutting line in the back surface side of the magnetic insulating substrate; and each of the external electrodes is surrounded by the magnetic insulating substrate and connects to the connection conductor formed on the side wall of one of the pairs of holes in the front surface side, and connects to the connection conductor formed on the side wall of the oblong hole in the back surface side.

11. The method of manufacturing an inductor according to claim 9, wherein:

the through-holes are pairs of holes located in line symmetry about the cutting line in the front surface side of the magnetic insulating substrate, and oblong holes extending across the cutting line in the back surface side of the magnetic insulating substrate; and each of the external electrodes is surrounded by the magnetic insulating substrate and connects to the connection conductor formed on the side wall of one of the pairs of holes in the front surface side, and connects to the connection conductor formed on the side wall of the oblong hole in the back surface side.

12. The method of manufacturing an inductor according to claim 8, wherein each of the through-holes is an oblong hole extending across the cutting line, and each of the external electrodes connects to the connection conductor formed on the side wall of the oblong hole.

13. The method of manufacturing an inductor according to claim 9, wherein each of the through-holes is an oblong hole extending across the cutting line, and each of the external electrodes connects to the connection conductor formed on the side wall of the oblong hole.

14. The method of manufacturing an inductor according to claim 8, wherein each of the through-holes is an oblong hole extending across the cutting line, and the external electrodes extend away from the cutting line.

15. The method of manufacturing an inductor according to claim 9, wherein each of the through-holes is an oblong hole extending across the cutting line, and the external electrodes extend away from the cutting line.

* * * * *